US010365008B2

(12) United States Patent
Yokota et al.

(10) Patent No.: US 10,365,008 B2
(45) Date of Patent: Jul. 30, 2019

(54) INDOOR UNIT FOR AIR-CONDITIONING APPARATUS

(71) Applicant: Mitsubishi Electric Corporation, Tokyo (JP)

(72) Inventors: Shuhei Yokota, Tokyo (JP); Masayuki Oishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/747,590

(22) PCT Filed: Aug. 7, 2015

(86) PCT No.: PCT/JP2015/072553
§ 371 (c)(1),
(2) Date: Jan. 25, 2018

(87) PCT Pub. No.: WO2017/026013
PCT Pub. Date: Feb. 16, 2017

(65) Prior Publication Data

US 2018/0238581 A1 Aug. 23, 2018

(51) Int. Cl.
*F24F 13/15* (2006.01)
*F24F 1/0011* (2019.01)
(Continued)

(52) U.S. Cl.
CPC ..... *F24F 13/15* (2013.01); *F24F 1/0011* (2013.01); *F24F 1/0014* (2013.01);
(Continued)

(58) Field of Classification Search
CPC ..... F24F 13/15; F24F 1/0067; F24F 1/0014; F24F 1/0011; F24F 1/0029; F24F 1/0057; F24F 13/222
See application file for complete search history.

(56) References Cited

U.S. PATENT DOCUMENTS

2012/0018117 A1* 1/2012 Yamada ..... F24F 1/0007 165/11.1
2012/0031139 A1* 2/2012 Shirota ..... F24F 1/0029 62/426
2013/0105125 A1* 5/2013 Oishi ..... F24F 13/20 165/121

FOREIGN PATENT DOCUMENTS

CN 103154620 A 6/2013
EP 2 602 561 A1 6/2013
(Continued)

OTHER PUBLICATIONS

International Search Report of the International Searching Authority dated Nov. 10, 2015 for the corresponding international application No. PCT/JP2015/072553 (and English translation).
(Continued)

*Primary Examiner* — Emmanuel E Duke
(74) *Attorney, Agent, or Firm* — Posz Law Group, PLC

(57) ABSTRACT

An indoor unit includes, in an airflow path, an axial fan, an indoor heat exchanger having a W-shape in side view, and a forward drain pan and a rearward drain each disposed below the corresponding valley portion of the indoor heat exchanger. The airflow path is divided into a first airflow path, a second airflow path, and a third airflow path. The indoor unit includes an up/down airflow direction flap disposed at the air outlet. The up/down airflow direction flap includes a rearward up/down airflow direction flap disposed under the second airflow path and the third airflow path, and a forward up/down airflow direction flap disposed forward of the rearward up/down airflow direction flap and under the first airflow path.

19 Claims, 16 Drawing Sheets

(51) Int. Cl.

| | |
|---|---|
| ***F24F 1/0014*** | (2019.01) |
| ***F24F 1/0029*** | (2019.01) |
| ***F24F 1/0067*** | (2019.01) |
| *F24F 13/22* | (2006.01) |
| *F24F 1/0057* | (2019.01) |

(52) U.S. Cl.

CPC ..... *F24F 1/0029* (2013.01); *F24F 1/0067* (2019.02); *F24F 1/0057* (2019.02); *F24F 13/222* (2013.01)

(56) References Cited

FOREIGN PATENT DOCUMENTS

| | | | |
|---|---|---|---|
| EP | 2602561 | A1 | 6/2013 |
| JP | 2012-037085 | A | 2/2012 |
| WO | 2012/017480 | A1 | 2/2012 |
| WO | WO2012/017478 | A1 | 2/2012 |

OTHER PUBLICATIONS

Office Action dated Nov. 5, 2018 issued in corresponding Chinese Patent Application No. 201580029355.6(and English translation).
Office Action dated Sep. 4, 2018 issued in corresponding JP patent application No. 2017-534041 (and English translation).
Extended EP Search Report dated Feb. 25, 2019 issued in corresponding EP patent application No. 15900968.7.

* cited by examiner

INDOOR UNIT FOR AIR-CONDITIONING APPARATUS

CROSS REFERENCE TO RELATED APPLICATION

This application is a U.S. national stage application of International Application No. PCT/JP2015/072553, filed on Aug. 7, 2015, the contents of which are incorporated herein by reference.

TECHNICAL FIELD

The present invention relates to a wall-mounted indoor unit for an air-conditioning apparatus that includes an axial fan disposed upstream of an indoor heat exchanger.

BACKGROUND

There has been proposed a wall-mounted indoor unit for an air-conditioning apparatus that includes an axial fan disposed upstream of an indoor heat exchanger (see, for example, Patent Literature 1). The indoor unit described in Patent Literature 1 includes a casing, an axial fan, and an indoor heat exchanger. The casing has an air inlet located on a top face portion, an air outlet extending from a bottom face portion to a lower front face portion, and an airflow path that communicates the air inlet and the air outlet with each other. The axial fan is disposed within the airflow path under the air inlet. The indoor heat exchanger is disposed within the airflow path under the axial fan.

The wall-mounted indoor unit for an air-conditioning apparatus also includes, at its air outlet, an up/down airflow direction flap that adjusts the up/down angle of air blown out from the air outlet, and a left/right airflow direction flap that adjusts the left/right angle of air blown out from the air outlet. At least one up/down airflow direction flap and at least one left/right airflow direction flap are provided for each single airflow path. For example, FIG. 7 or other figures of Patent Literature 1 disclose an indoor unit including two up/down airflow direction flaps for a single airflow path.

Further, FIG. 11 of Patent Literature 1 discloses an indoor unit in which an indoor heat exchanger having a W-shape in side view is disposed downstream of, that is, under, the axial fan.

PATENT LITERATURE

Patent Literature 1: Japanese Unexamined Patent Application Publication No. 2012-37085

When indoor air is cooled by an indoor heat exchanger in cooling operation, moisture contained in the indoor air deposits on the indoor heat exchanger as dew. For this reason, a drain pan is disposed below the bottom end portion of the indoor heat exchanger to receive dew dripping down from the indoor heat exchanger. That is, in the case of an indoor heat exchanger having a W-shape in side view, a forward drain pan is disposed below the forward valley portion of the indoor heat exchanger, and a rearward drain pan is disposed below the rearward valley portion of the indoor heat exchanger. Consequently, if an indoor heat exchanger having a W-shape in side view is employed for a wall-mounted indoor unit for an air-conditioning apparatus that has an axial fan disposed upstream of an indoor heat exchanger, the airflow path inside the casing is divided into three parts by the forward drain pan and the rearward drain pan. More specifically, the airflow path is divided by the forward drain pan and the rearward drain pan into a first airflow path defined between the front wall of the airflow path and the forward drain pan, a second airflow path defined between the forward drain pan and the rearward drain pan, and a third airflow path defined between the rearward drain pan and the back wall of the airflow path.

As described above, conventional indoor units have, for each single airflow path, one or more up/down airflow direction flaps and one or more left/right airflow direction flaps that are disposed at the air outlet. Consequently, in related art, if an indoor heat exchanger having a W-shape in side view is employed for a wall-mounted indoor unit for an air-conditioning apparatus that has an axial fan disposed upstream of an indoor heat exchanger, at least three up/down airflow direction flaps and at least three left/right airflow direction flaps are disposed at the air outlet. Therefore, in related art, if an indoor heat exchanger having a W-shape in side view is employed for a wall-mounted indoor unit for an air-conditioning apparatus that has an axial fan disposed upstream of an indoor heat exchanger, this increases the complexity of the structure of the up/down and left/right airflow direction flaps. The increased complexity of the structure of the up/down and left/right airflow direction flaps also adds complexity to the control of the up/down and left/right airflow direction flaps.

SUMMARY

The present invention has been made to address the above-mentioned problem. Accordingly, it is an object of the invention to provide an indoor unit for an air-conditioning apparatus that, when used as a wall-mounted indoor unit for an air-conditioning apparatus that has an axial fan disposed upstream of an indoor heat exchanger having a W-shape in side view, allows for simplified structure and control of an up/down airflow direction flap.

An indoor unit for an air-conditioning apparatus according to an embodiment of the present invention includes a casing having an air inlet located on a top face portion, an air outlet extending from a bottom face portion to a lower front face portion, and an airflow path that communicates the air inlet and the air outlet with each other, an axial fan disposed within the airflow path under the air inlet, an indoor heat exchanger disposed within the airflow path under the axial fan, the indoor heat exchanger having a W-shape in side view, a forward drain pan disposed within the airflow path below a forward valley portion of the indoor heat exchanger, and a rearward drain pan disposed within the airflow path below a rearward valley portion of the indoor heat exchanger. The airflow path is divided by the forward drain pan and the rearward drain pan into a first airflow path, a second airflow path, and a third airflow path, the first airflow path being defined between the front wall of the airflow path and the forward drain pan, the second airflow path being defined between the forward drain pan and the rearward drain pan, the third airflow path being defined between the rearward drain pan and the back wall of the airflow path. The indoor unit includes an up/down airflow direction flap that adjusts the up/down angle of air blown out from the air outlet, the up/down airflow direction flap including a forward up/down airflow direction flap and a rearward up/down airflow direction flap that are disposed separately in a portion of the air outlet located on the bottom face portion of the casing and whose at least front end portion is swingable in the up/down direction. The rearward up/down airflow direction flap is disposed under the second airflow path and the third airflow path such that in side view, the front end portion of the rearward up/down airflow direction flap is located at the same position as the rear end portion of the second airflow path or located forward of the second airflow path. The forward up/down airflow direction flap is disposed such that in side view, the forward up/down airflow direction flap is located forward of the rearward up/down airflow direction flap and under the first airflow path.

The indoor unit for an air-conditioning apparatus according to an embodiment of the present invention is configured as described above. This configuration ensures that, for a wall-mounted indoor unit for an air-conditioning apparatus that includes an axial fan disposed upstream of an indoor heat exchanger having a W-shape in side view, the structure and control of an up/down airflow direction flap can be simplified.

DETAILED DESCRIPTION

Embodiment 1

Figure 1:
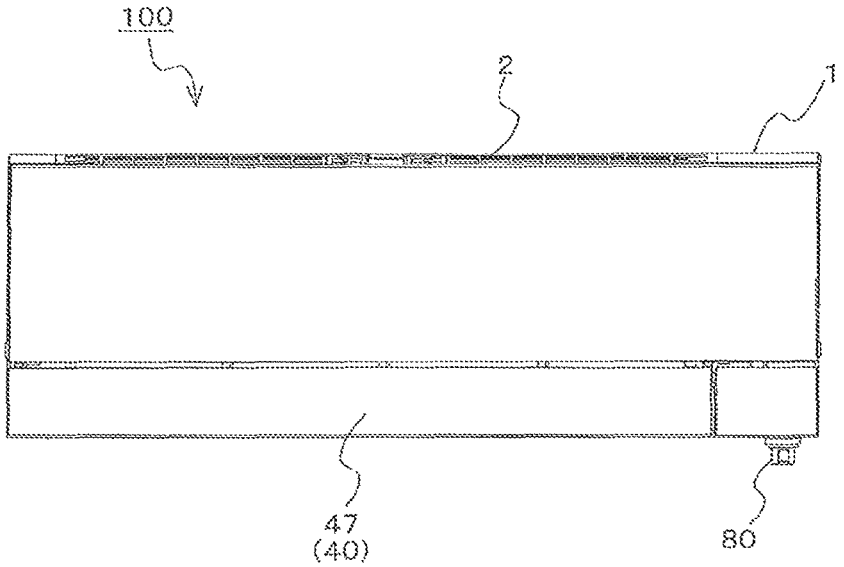
FIG. 1 is a front view of an indoor unit for an air-conditioning apparatus according to Embodiment 1 of the present invention.
Figure 2:
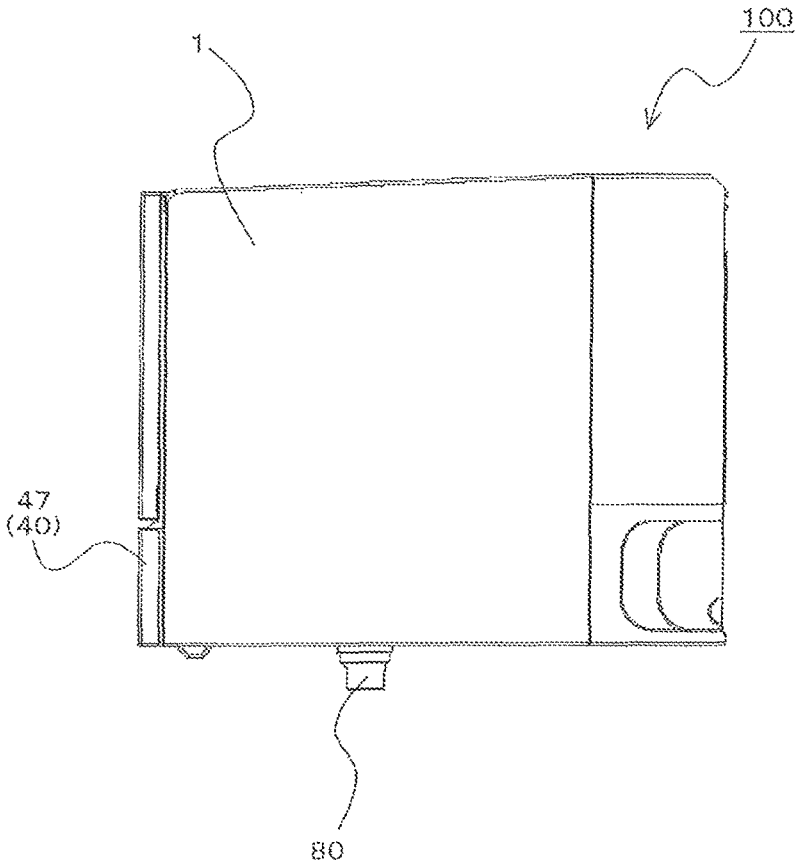
FIG. 2 is a right side view of the indoor unit for an air-conditioning apparatus according to Embodiment 1 of the present invention.
Figure 3:
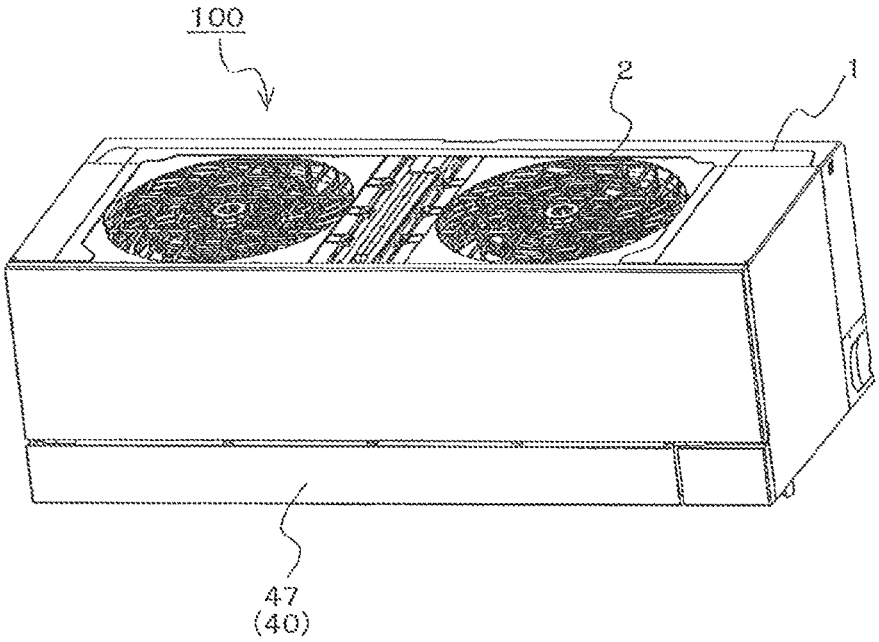
FIG. 3 is a perspective view, as seen from the right front, of the indoor unit for an air-conditioning apparatus according to Embodiment 1 of the present invention.
Figure 4:
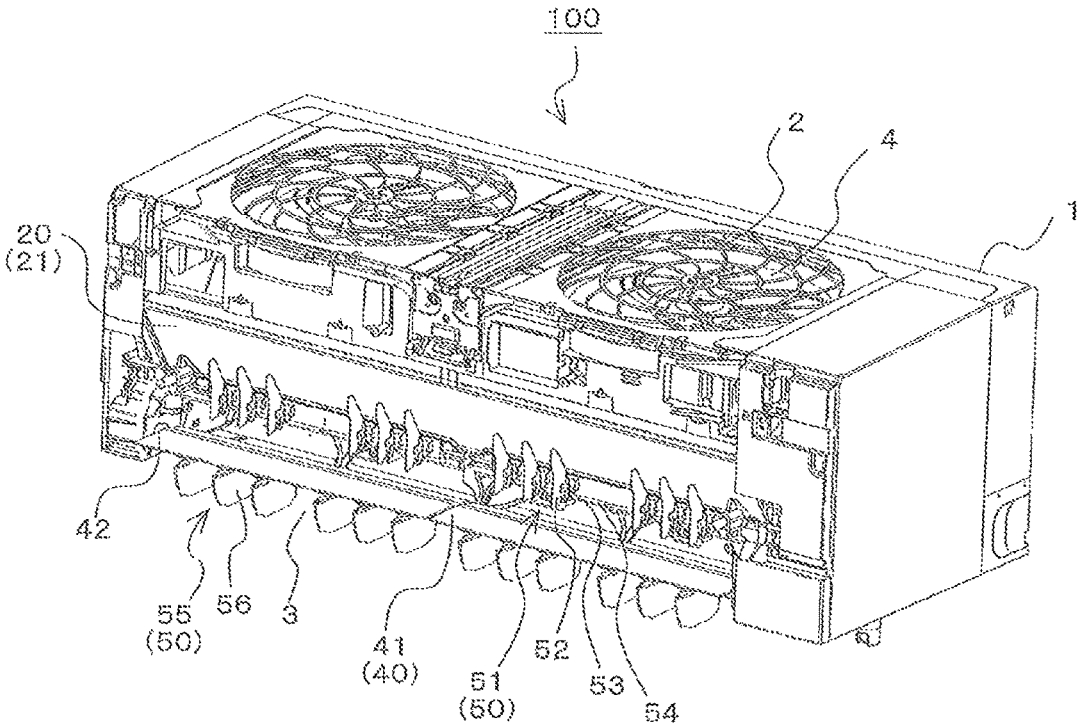
FIG. 4 is a perspective view, as seen from the right front, of the indoor unit for an air-conditioning apparatus according to Embodiment 1 of the present invention.
Figure 5:
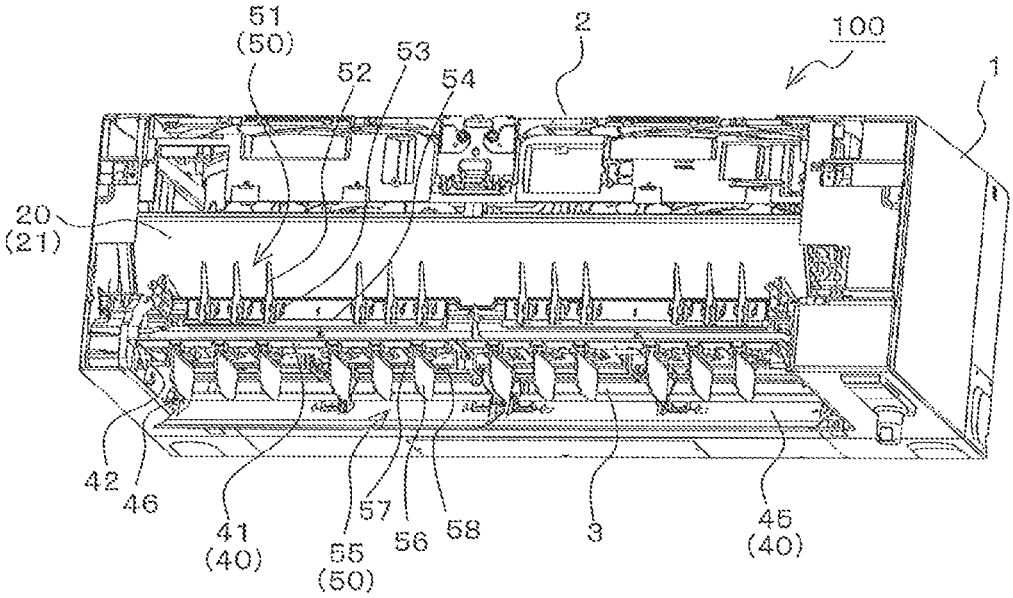
FIG. 5 is a perspective view, as seen from the right front, of the indoor unit for an air-conditioning apparatus according to Embodiment 1 of the present invention.
Figure 6:
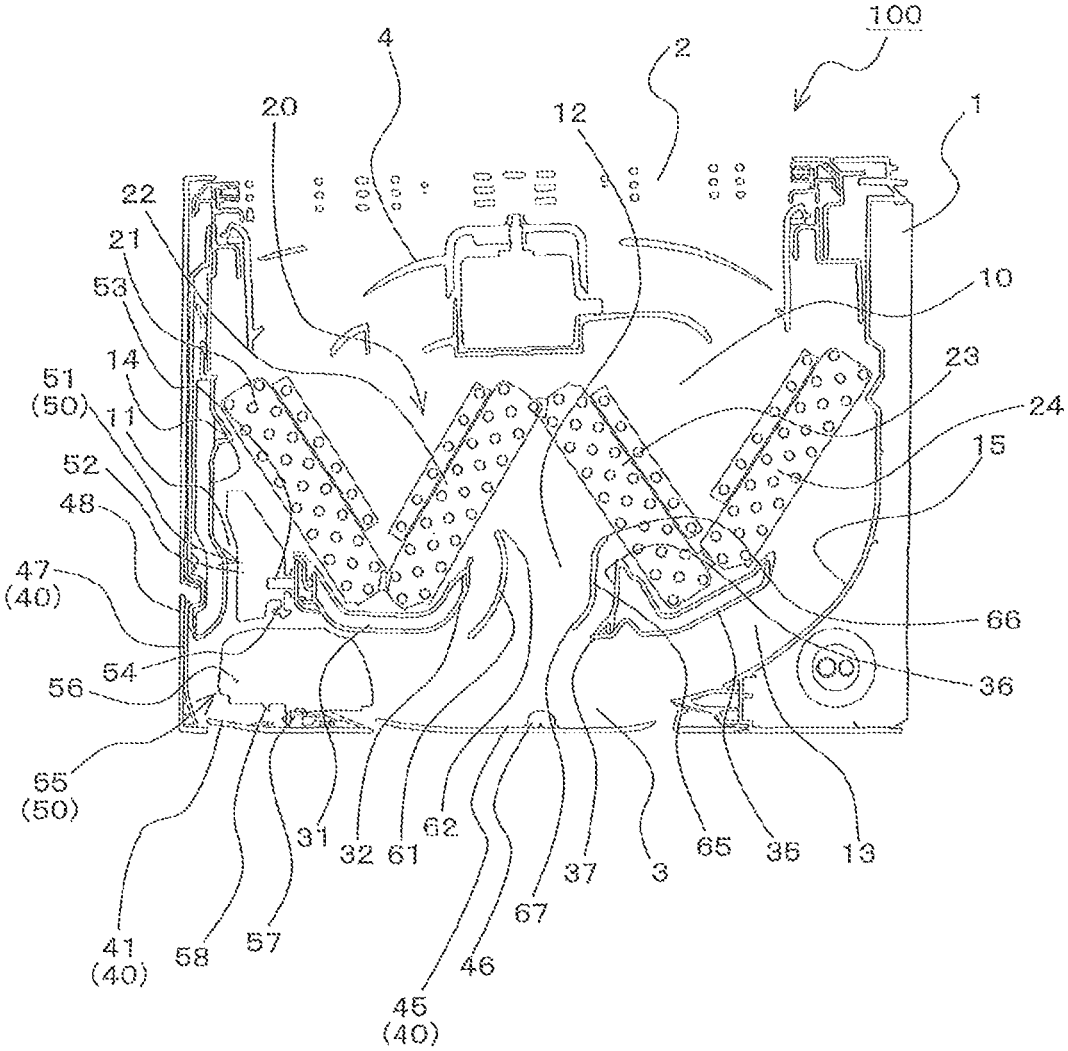
FIG. 6 is a longitudinal sectional view, as seen from right, of the indoor unit for an air-conditioning apparatus according to Embodiment 1 of the present invention.

FIG. 1 is a front view of an indoor unit for an air-conditioning apparatus according to Embodiment 1 of the present invention. FIG. 2 is a right side view of the indoor unit for an air-conditioning apparatus according to Embodiment 1 of the present invention. FIGS. 3 to 5 are perspective views, as seen from the right front, of the indoor unit for an air-conditioning apparatus according to Embodiment 1 of the present invention. FIG. 6 is a longitudinal sectional view, as seen from right, of the indoor unit for an air-conditioning apparatus according to Embodiment 1 of the present invention.

FIG. 4 is a view, as seen from above and right, of an indoor unit 100 with a front wall 14 of an airflow path 10 and a front up/down airflow direction flap 47 removed. FIG. 5 is a view, as seen from below and right, of the indoor unit 100 with the front wall 14 of the airflow path 10 and the front up/down airflow direction flap 47 removed. In FIG. 6, the left-hand side of the figure corresponds to the front side of the indoor unit 100. As will be described later, when the indoor unit 100 according to Embodiment 1 is in operation, a forward up/down airflow direction flap 41 is turned over for use. That is, FIGS. 4 and 5 each illustrate the state of the forward up/down airflow direction flap 41 when the indoor unit 100 is in operation, and FIG. 6 illustrates the state of the forward up/down airflow direction flap 41 when the indoor unit 100 is not in operation.

The indoor unit 100 uses a refrigeration cycle that causes refrigerant to circulate to thereby supply conditioned air to an air-conditioned space such as a room. The indoor unit 100 is a wall-mounted indoor unit mounted on an indoor wall, for example. The indoor unit 100 includes a casing 1 that constitutes the outer shell of the indoor unit 100. The casing 1 includes an air inlet 2 located on a top face portion, an air outlet 3 extending from a bottom face portion to a lower front face portion, and the airflow path 10 that communicates the air inlet 2 and the air outlet 3 with each other. An axial fan 4 and an indoor heat exchanger 20 are disposed within the airflow path 10. In Embodiment 1, the back side portion of the front face portion of the casing 1 constitutes the front wall 14 of the airflow path 10. The front side portion of the back face portion of the casing 1 constitutes a back wall 15 of the airflow path 10. The left and right side wall portions of the airflow path 10 are respectively formed by side plates or other components (not illustrated) located at left and right side end portions of the indoor heat exchanger 20.

The axial fan 4 sucks indoor air into the airflow path 10 from the air inlet 2, and sends the indoor air to the indoor heat exchanger 20 so that conditioned air, which is the indoor air that has undergone heat exchange in the indoor heat exchanger 20, is blown out from the air outlet 3. The axial fan 4 is disposed under the air inlet 2, that is, downstream of the air inlet 2. The axial fan 4 is, for example, a propeller fan. Generally, there is often only a limited space available for installing the axial fan 4 within an indoor unit for an air-conditioning apparatus, and this space constraint makes it difficult to increase the size of the axial fan 4. Accordingly, to obtain a desired quantity of air, Embodiment 1 employs a plurality of (two in Embodiment 1) axial fans 4 arranged side by side in the longitudinal direction (left/right direction) of the casing 1.

The number of axial fans 4 is not limited to more than one. The indoor unit 100 may be provided with only one axial fan 4 as long as a desired quantity of air can be obtained. In Embodiment 1, examples of axial fans also include mixed flow fans. This is because the general direction of flow of air created by mixed flow fans is also along the fan's rotational axis.

The indoor heat exchanger 20 allows refrigerant flowing within the indoor heat exchanger 20 and indoor air to exchange heat to thereby create conditioned air. The indoor heat exchanger 20 is disposed under the axial fan 4, that is, downstream of the axial fan 4. The indoor heat exchanger 20 is, for example, a fin-tube heat exchanger including a plurality of fins arranged side by side at predetermined intervals, and a plurality of heat exchanger tubes that penetrate the above-mentioned fins in the direction of arrangement of these fins and into which refrigerant flows. The indoor heat exchanger 20 has a W-shape in side view.

More specifically, the indoor heat exchanger 20 includes a first heat exchanger 21, a second heat exchanger 22, a third heat exchanger 23, and a fourth heat exchanger 24, which are fin-tube heat exchangers, for example. The first heat exchanger 21, the second heat exchanger 22, the third heat exchanger 23, and the fourth heat exchanger 24 are placed in this order within the airflow path 10 from the front wall 14 toward the back wall 15. Thus, the indoor heat exchanger 20 has a W-shape in side view.

When indoor air is cooled in the indoor heat exchanger 20 during cooling operation, moisture contained in the indoor air deposits onto the indoor heat exchanger 20 as dew. For this reason, a drain pan is disposed below the bottom end portion of the indoor heat exchanger 20 to receive dew dripping down from the indoor heat exchanger 20. More specifically, for the indoor heat exchanger 20 according to Embodiment 1 that has a W-shape in side view, a forward drain pan 31 is disposed below the forward valley portion of the indoor heat exchanger 20, that is, below the connecting portion of the first heat exchanger 21 and the second heat exchanger 22. Further, a rearward drain pan 35 is disposed below the rearward valley portion of the indoor heat exchanger 20, that is, below the connecting portion of the third heat exchanger 23 and the fourth heat exchanger 24.

Figure 7:
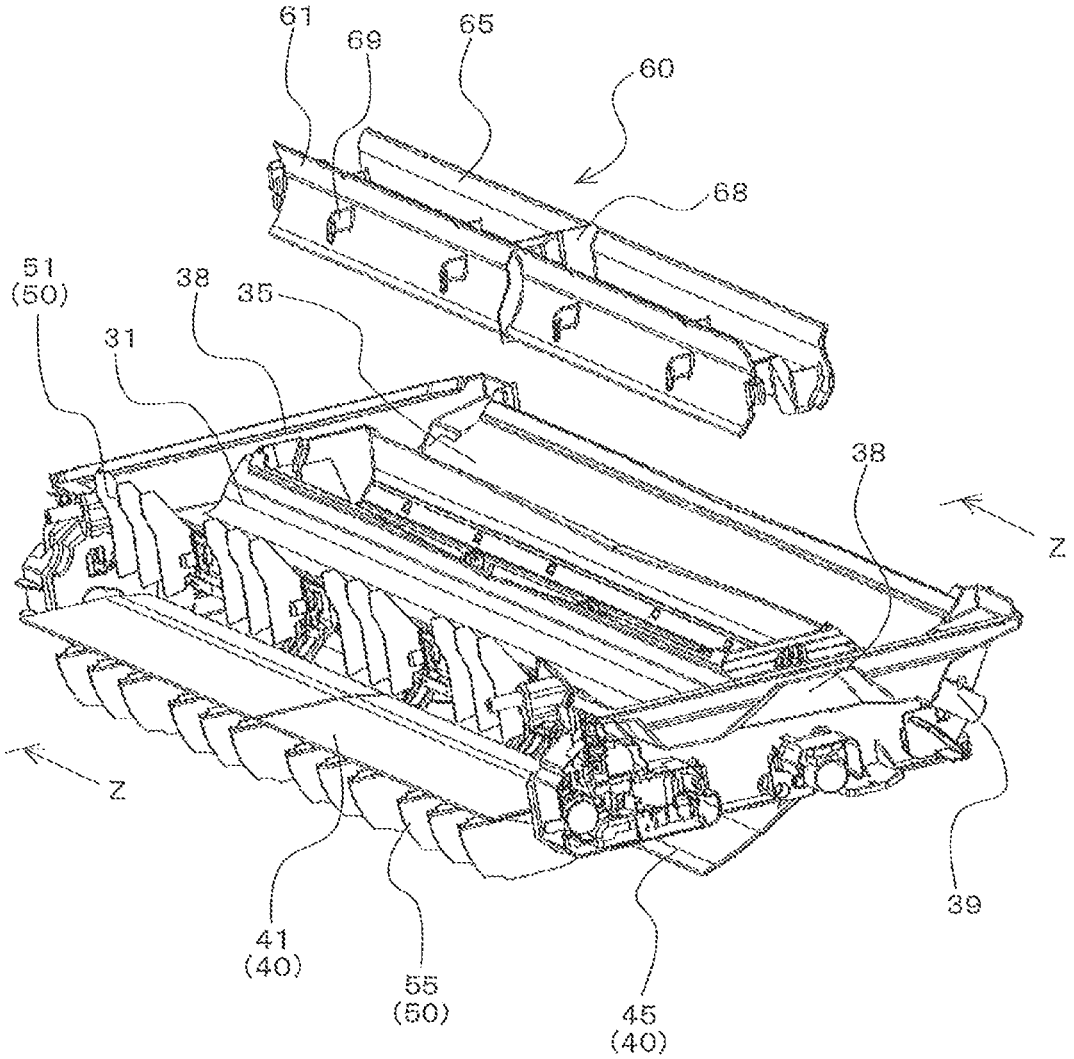
FIG. 7 is a perspective view, as seen from the right front, of a forward drain pan and a rearward drain pan according to Embodiment 1 of the present invention.
Figure 8:
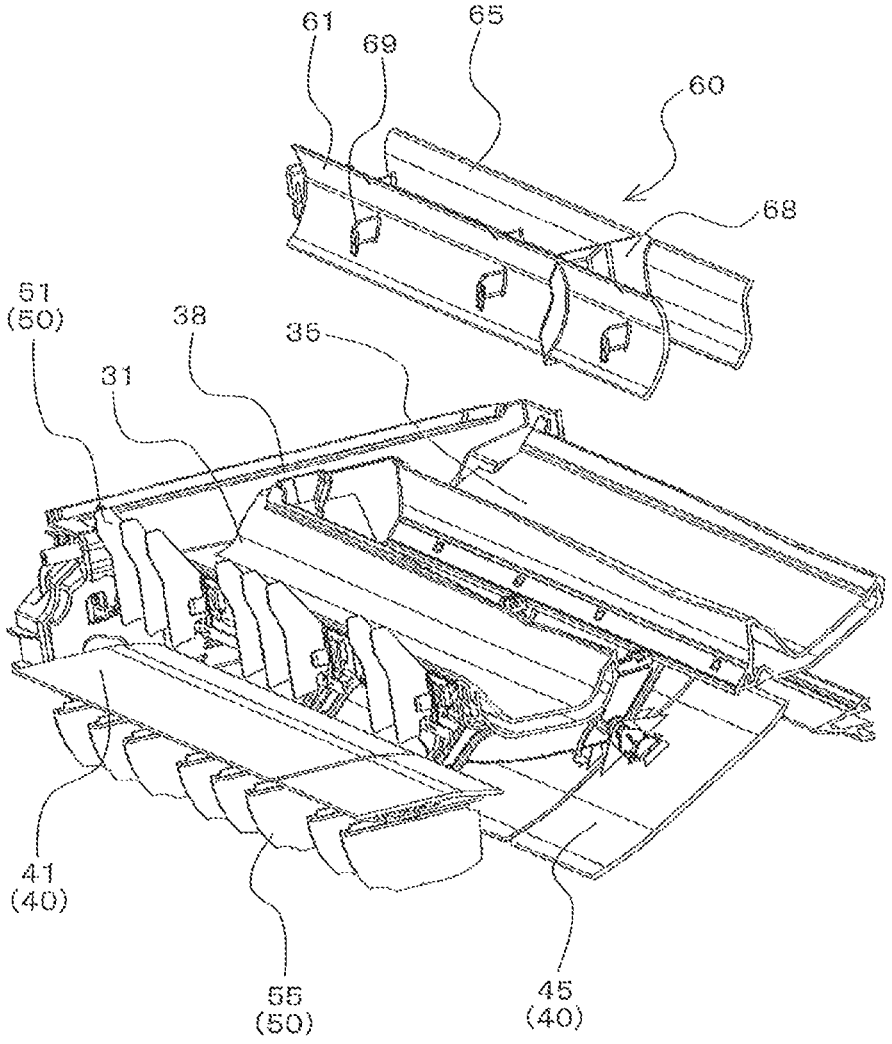
FIG. 8 is a sectional view taken along a line Z-Z of FIG. 7.

FIG. 7 is a perspective view, as seen from the right front, of the forward and rearward drain pans according to Embodiment 1 of the present invention. FIG. 8 is a sectional view taken along a line Z-Z of FIG. 7. FIGS. 7 and 8 also depict the following components described later: the forward up/down airflow direction flap 41, a rearward up/down airflow direction flap 45, a first left/right airflow direction flap 51, a second left/right airflow direction flap 55, a forward straightening vane 61, and a rearward straightening vane 65. Further, FIGS. 7 and 8 depict the state of the forward straightening vane 61 and the rearward straightening vane 65 prior to their attachment to the forward drain pan 31 and the rearward drain pan 35, respectively.

As illustrated in FIGS. 7 and 8, the left and right end portions of the forward drain pan 31 and the rearward drain pan 35 are both connected with drainage channels 38. A connection port 39 for connection with a drain hose (not illustrated) is provided on the back side of at least one of the drainage channels 38. That is, dew collected by each of the forward drain pans 31 and the rearward drain pan 35 is routed through the drainage channel 38, the connection port 39, and the drain hose (not illustrated), and discharged to the outside of the indoor unit 100.

As described above, the forward drain pan 31 and the rearward drain pan 35 are disposed below the indoor heat exchanger 20 that has a W-shape in side view. As a result, the airflow path 10 within the casing 1 is divided into three parts by the forward drain pan 31 and the rearward drain pan 35. More specifically, as illustrated in FIG. 6, the airflow path 10 is divided by the forward drain pan 31 and the rearward drain pan 35 into the following airflow paths: a first airflow path 11 defined between the front wall 14 of the airflow path 10 and the forward drain pan 31, a second airflow path 12 defined between the forward drain pan 31 and the rearward drain pan 35, and a third airflow path 13 defined between the rearward drain pan 35 and the back wall 15 of the airflow path 10.

Further, the indoor unit 100 according to Embodiment 1 includes, in the airflow path 10, an up/down airflow direction flap 40 that adjusts the up/down angle of air blown out from the air outlet 3, and a left/right airflow direction flap 50 that adjusts the left/right angle of air blown out from the air outlet 3.

In conventional wall-mounted indoor units, one or more up/down airflow direction flaps and one or more left/right airflow direction flaps are provided at the air outlet for each single airflow path. Accordingly, if the indoor unit 100 including the first airflow path 11, the second airflow path 12, and the third airflow path 13 is to be provided with up/down and left/right airflow direction flaps in accordance with the related art, the indoor unit 100 is provided with at least three up/down airflow direction flaps and at least three left/right airflow direction flaps. This increases the complexity of the structure of the up/down airflow direction flaps and the left/right airflow direction flaps. The increased complexity of the structure of the up/down airflow direction flaps and the left/right airflow direction flaps also adds complexity to the control of the up/down airflow direction flaps and the left/right airflow direction flaps.

Accordingly, in the indoor unit 100 according to Embodiment 1, the up/down airflow direction flap 40 and the left/right airflow direction flap 50 are configured as described below.

The indoor unit 100 includes, as the up/down airflow direction flap 40, the forward up/down airflow direction flap 41, the rearward up/down airflow direction flap 45, and the front up/down airflow direction flap 47. The forward up/down airflow direction flap 41 and the rearward up/down airflow direction flap 45 are disposed separately in a portion of the air outlet 3 located on the bottom face portion of the casing 1. The forward up/down airflow direction flap 41 and the rearward up/down airflow direction flap 45 are disposed such that at least their front end portion is swingable in the up/down direction. The front up/down airflow direction flap 47 is disposed in a portion of the air outlet 3 located on the front face portion of the casing 1 such that at least its lower end portion is swingable in side view. When the indoor unit 100 is not in operation, the forward up/down airflow direction flap 41, the rearward up/down airflow direction flap 45, and the front up/down airflow direction flap 47 close the air outlet 3. This configuration enhances the design of the indoor unit 100.

As will be described later, the front up/down airflow direction flap 47 is provided for the purpose of enhancing heating performance in heating operation, and the up/down airflow direction flap 40 may not necessarily include the front up/down airflow direction flap 47.

More specifically, in side view, the rearward up/down airflow direction flap 45 is disposed under the second airflow path 12 and the third airflow path 13. The rearward up/down airflow direction flap 45 guides the air blown out from the second airflow path 12 and the third airflow path 13 forward, that is, toward the forward up/down airflow direction flap 41. The rearward up/down airflow direction flap 45 is a plate-like member elongated in the left/right direction of the casing 1. In side view, the rearward up/down airflow direction flap 45 has a gentle arcuate shape that is downwardly convex. The rearward up/down airflow direction flap 45 has, at a location slightly rearward of the center of the rearward up/down airflow direction flap 45 in side view, a rotary shaft 46 that extends in the left/right direction. That is, the front and rear end portions of the rearward up/down airflow direction flap 45 are swingable in the up/down direction about the rotary shaft 46.

The rearward up/down airflow direction flap 45 is disposed such that its front end portion is located at the same position as the front end portion of the second airflow path 12 or located forward of the second airflow path. In this regard, the front end portion of the second airflow path 12 refers to the portion of the forward drain pan 31 that projects most rearward. As illustrated in FIG. 6, the lower portion of the back wall 15 that constitutes the back side of the third airflow path 13 projects forward as the back wall 15 extends downward, so that air blowing out from the third airflow path 13 is guided forward. The rear end portion of the rearward up/down airflow direction flap 45 is located slightly forward of the bottom end portion of the back wall 15 that constitutes the back side of the third airflow path 13.

In side view, the forward up/down airflow direction flap 41 is located forward of the rearward up/down airflow direction flap 45 and under the first airflow path 11. The forward up/down airflow direction flap 41 adjusts the up/down angle of air blown out from the first airflow path 11, and the up/down angle of air guided to the forward up/down airflow direction flap 41 from the rearward up/down airflow direction flap 45. As a result, the up/down angle of air blown out from the air outlet 3 is adjusted. The forward up/down airflow direction flap 41, which is a plate-like member elongated in the left/right direction of the casing 1, includes a rotary shaft 42 extending in the left/right direction. That is, in side view, the forward up/down airflow direction flap 41 is rotatable about the rotary shaft 42.

Figure 10:
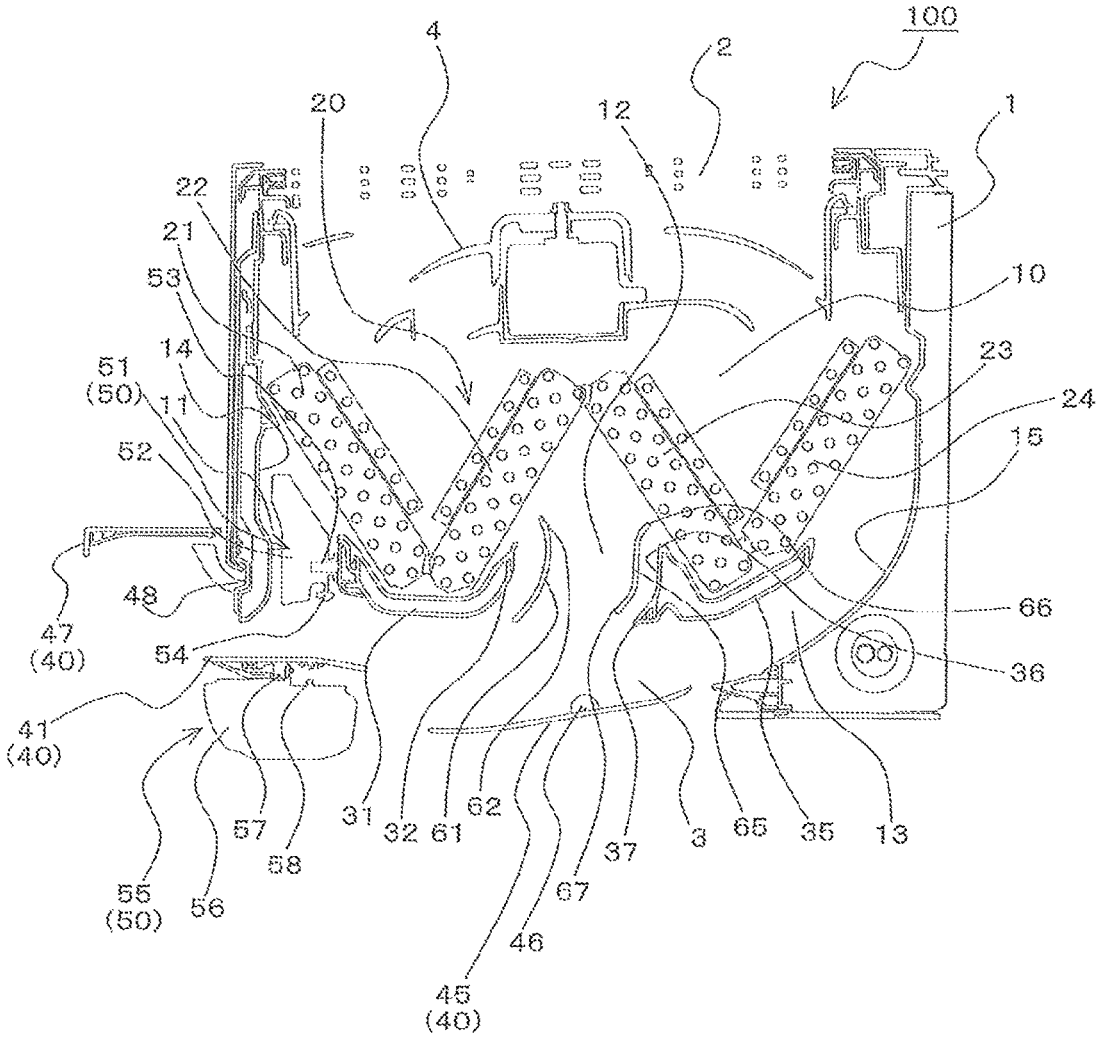
FIG. 10 is an illustration for explaining the cooling operation of the indoor unit for an air-conditioning apparatus according to Embodiment 1.

For example, as illustrated in FIGS. 4 to 6, the configuration of the indoor unit 100 according to Embodiment 1 is such that when the indoor unit 100 is in operation, the forward up/down airflow direction flap 41 rotates about the rotary shaft 42, and is turned over for use from the position of the forward up/down airflow direction flap 41 when the indoor unit 100 is not in operation. When the indoor unit 100 is in operation, the front and rear end portions of the forward up/down airflow direction flap 41 are swingable in the up/down direction about the rotary shaft 42. Further, as illustrated in FIG. 10 described later, at least when the forward up/down airflow direction flap 41 is set to the horizontal position in side view during operation of the indoor unit 100, the front end portion of the forward up/down airflow direction flap 41 is located forward of the first airflow path 11.

The front up/down airflow direction flap 47 adjusts the up/down angle of air that is blown out from the air outlet 3 in heating operation. The front up/down airflow direction flap 47, which is a plate-like member elongated in the left/right direction of the casing 1, includes a rotary shaft 48 extending in the left/right direction. That is, the lower end portion of the front up/down airflow direction flap 47 swings as the front up/down airflow direction flap 47 rotates about the rotary shaft 48. The front up/down airflow direction flap 47 is not necessarily an indispensable component for cooling operation. Due to the above-mentioned configuration, as illustrated in FIG. 10 described later, in cooling operation, the front up/down airflow direction flap 47 rotates until its lower end portion is located above the air outlet 3, thus fully opening the portion of the air outlet 3 located on the front face portion of the casing 1.

The indoor unit 100 includes, as the left/right airflow direction flap 50, the first left/right airflow direction flap 51 and the second left/right airflow direction flap 55. The first left/right airflow direction flap 51 is disposed in the first airflow path 11 to adjust the left/right angle of air blown out from the first airflow path 11. The first left/right airflow direction flap 51 includes a plurality of plate members 52 whose at least one of upper and lower end portions are swingable in the left/right direction. The plate members 52 are arranged side by side at predetermined intervals in the left/right direction of the casing 1. Each of the plate members 52 has a rotary shaft 53. The plate members 52 are connected by a connecting member 54 that extends in the left/right direction. That is, when the connecting member 54 is moved in the left/right direction of the casing 1, the plate members 52 rotates about the rotary shaft 53 so that its upper and lower end portions swing in the left/right direction.

The plate members 52 correspond to first plate members according to the present invention.

The second left/right airflow direction flap 55 adjusts the left/right angle of air guided to the second left/right airflow direction flap 55 from the rearward up/down airflow direction flap 45. The second left/right airflow direction flap 55 is disposed on the forward up/down airflow direction flap 41. More specifically, the second left/right airflow direction flap 55 is disposed on a side of the forward up/down airflow direction flap 41 that becomes the bottom side when the forward up/down airflow direction flap 41 is set to the horizontal position during operation of the indoor unit 100. The second left/right airflow direction flap 55 includes a plurality of plate members 56 whose at least one of forward and rearward end portions are swingable in the left/right direction. The plate members 56 are arranged side by side at predetermined intervals in the left/right direction of the casing 1. Each of the plate members 56 has a rotary shaft 57. The plate members 56 are connected by a connecting member 58 that extends in the left/right direction. That is, when the connecting member 58 is moved in the left/right direction of the casing 1, each of the plate members 56 rotates about the rotary shaft 57 so that its forward and rearward end portions swing in the left/right direction.

The plate members 56 correspond to second plate members according to the present invention. The second left/right airflow direction flap 55 may not necessarily be disposed on the forward up/down airflow direction flap 41 but may be mounted separately from the forward up/down airflow direction flap 41. However, if the second left/right airflow direction flap 55 is disposed on the forward up/down airflow direction flap 41, this configuration allows the second left/right airflow direction flap 55 to be accommodated within the casing 1 when the indoor unit 100 is not in operation, thus allowing for enhanced design of the indoor unit 100.

The indoor unit 100 according to Embodiment 1 includes the forward straightening vane 61 and the rearward straightening vane 65 that are disposed in the airflow path 10 to straighten airflow. The forward straightening vane 61 is a plate-like member elongated in the left/right direction of the casing 1. As illustrated in FIG. 6, the forward straightening vane 61 is disposed in rear of the forward drain pan 31 with a predetermined spacing therebetween. To ensure that air blown out from the second airflow path 12 readily flows forward, a back face 32 of the forward drain pan 31, which also serves as the front wall of the second airflow path 12, has an arcuate shape that is downwardly convex in side view such that the back face 32 is inclined forward from its upper portion to its lower portion. In side view, the forward straightening vane 61 has a shape that conforms to the shape of the back face 32 of the forward drain pan 31. To facilitate guiding of air to the space between the forward straightening vane 61 and the forward drain pan 31, a top end portion 62 of the forward straightening vane 61 is located above the forward drain pan 31, and in side view, the top end portion 62 projects toward the forward drain pan 31. That is, the forward straightening vane 61 also has an arcuate shape that is downwardly convex in side view.

The rearward straightening vane 65 is a plate-like member elongated in the left/right direction of the casing 1. The rearward straightening vane 65 is disposed in front of the rearward drain pan 35 with a predetermined spacing therebetween. As with the back face 32 of the forward drain pan 31, a front face 36 of the rearward drain pan 35, which also serves as the back wall of the second airflow path 12, has a shape that allows air blown out from the second airflow path 12 to readily flow forward. More specifically, the front face 36 of the rearward drain pan 35 has a shape that is inclined forward from its upper portion to its lower portion. A projection 37, which causes air blown out from the second airflow path 12 to bend forward, projects forward from the bottom end portion of the front face 36 of the rearward drain pan 35. In side view, the rearward straightening vane 65 has a shape that conforms to the shape of the front face 36 of the rearward drain pan 35. That is, the middle portion of the rearward straightening vane 65 has a shape that is inclined forward from its upper portion to its lower portion. A bottom end portion 67 of the rearward straightening vane 65 projects forward along the projection 37 of the rearward drain pan 35. Further, to allow air to be readily guided to the space between the rearward straightening vane 65 and the rearward drain pan 35, a top end portion 66 of the rearward straightening vane 65 is located above the rearward drain pan 35, and in side view, the top end portion 66 projects toward the rearward drain pan 35. That is, the rearward straightening vane 65 has a substantially S-shape in side view.

As illustrated in FIGS. 7 and 8, in Embodiment 1, the forward straightening vane 61 and the rearward straightening vane 65 are connected by a connecting plate 68 to form a straightening vane unit 60. The straightening vane unit 60 has a plurality of claws 69 projecting from the front side of the forward straightening vane 61 and the back side of the rearward straightening vane 65. The claws 69 are inserted into recesses (not illustrated) in the forward drain pan 31 and the rearward drain pan 35 to secure the forward straightening vane 61 and the rearward straightening vane 65 to their respective locations mentioned above. The straightening vane unit 60 may be integrated with the forward drain pan 31 and the rearward drain pan 35.

The indoor unit 100 according to Embodiment 1 further includes components such as an infrared sensor 80 and a control device 90. The infrared sensor 80 detects information such as indoor temperature distribution, and user's location in the indoor space. The infrared sensor 80 projects from the bottom face portion of the casing 1.

Figure 9:
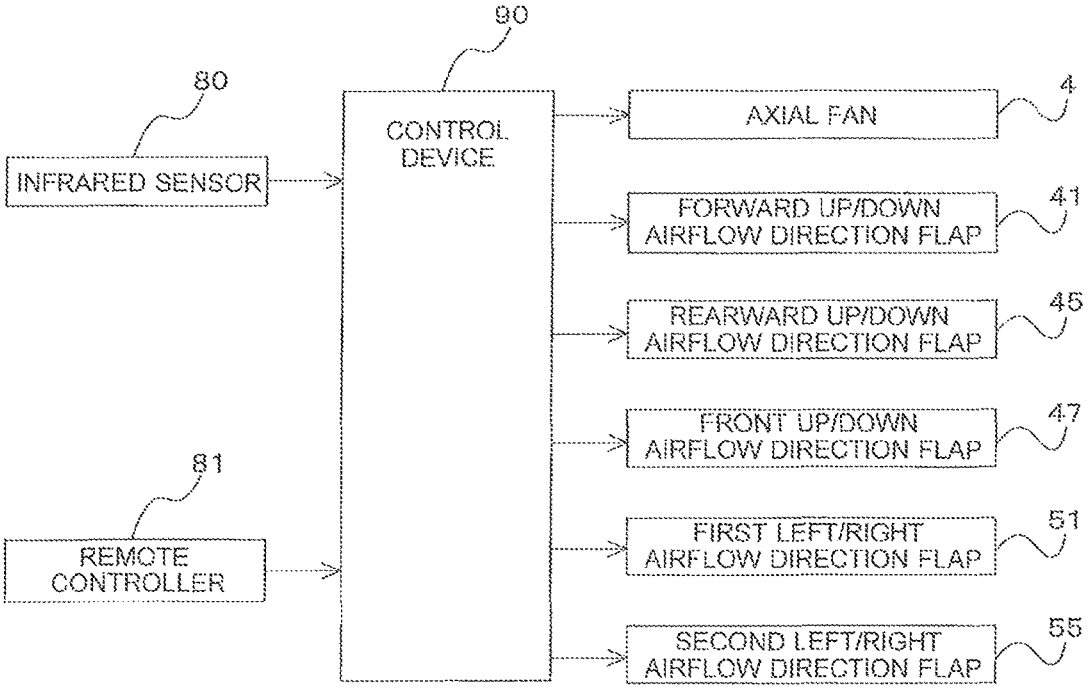
FIG. 9 illustrates a hardware configuration of the indoor unit for an air-conditioning apparatus according to Embodiment 1 of the present invention.

FIG. 9 illustrates a hardware configuration of the indoor unit for an air-conditioning apparatus according to Embodiment 1 of the present invention.

The control device 90 is implemented by dedicated hardware, or a central processing unit (CPU) (also called processing unit, arithmetic unit, microprocessor, microcomputer, or processor) that executes a program stored in a memory. The control device 90 is stored in a location within the casing 1 other than the airflow path 10, for example.

If the control device 90 is implemented by dedicated hardware, the control device 90 corresponds to, for example, a single circuit, a composite circuit, an application specific integrated circuit (ASIC), a field-programmable gate array (FPGA), or a combination thereof. Each of the functional units implemented by the control device 90 may be implemented individually by a separate piece of hardware, or the functional units may be implemented by a single piece of hardware.

If the control device 90 is a CPU, each function executed by the control device 90 is implemented by software, firmware, or a combination of software and firmware. Such software or firmware is written as a program and stored in a memory. The CPU reads and executes the program stored in the memory to implement each function of the control device 90. Examples of such a memory include a non-volatile or volatile semiconductor memory such as a RAM, a ROM, a flash memory, an EPROM, or an EEPROM.

Some of the functions of the control device 90 may be implemented by dedicated hardware, and some of the functions may be implemented by software or firmware.

In Embodiment 1, the control device 90 controls components such as the axial fan 4, the up/down airflow direction flap 40, and the left/right airflow direction flap 50 based on information such as the detection result of the infrared sensor 80 and operating information input to a remote controller 81. More specifically, the control device 90 controls starting, stoppage, and rotation speed of the axial fan 4. The control device 90 controls a driving device such as a motor (not illustrated) connected to the rotary shaft 42 of the forward up/down airflow direction flap 41 to thereby control the angle of the forward up/down airflow direction flap 41. The control device 90 controls a driving device such as a motor (not illustrated) connected to the rotary shaft 46 of the rearward up/down airflow direction flap 45 to thereby control the angle of the rearward up/down airflow direction flap 45. The control device 90 controls a driving device such as a motor (not illustrated) connected to the rotary shaft 48 of the front up/down airflow direction flap 47 to thereby control the angle of the front up/down airflow direction flap 47. The control device 90 controls a driving device such as a motor (not illustrated) connected to the connecting member 54 of the first left/right airflow direction flap 51 to thereby move the connecting member 54 to control the angle of the plate members 52 of the first left/right airflow direction flap 51. The control device 90 controls a driving device such as a motor (not illustrated) connected to the connecting member 58 of the second left/right airflow direction flap 55 to thereby move the connecting member 58 to control the angle of the plate members 56 of the second left/right airflow direction flap 55.

[Operation]

Next, operation of the indoor unit 100 configured as described above will be described.

(Cooling Operation)

Figure 11:
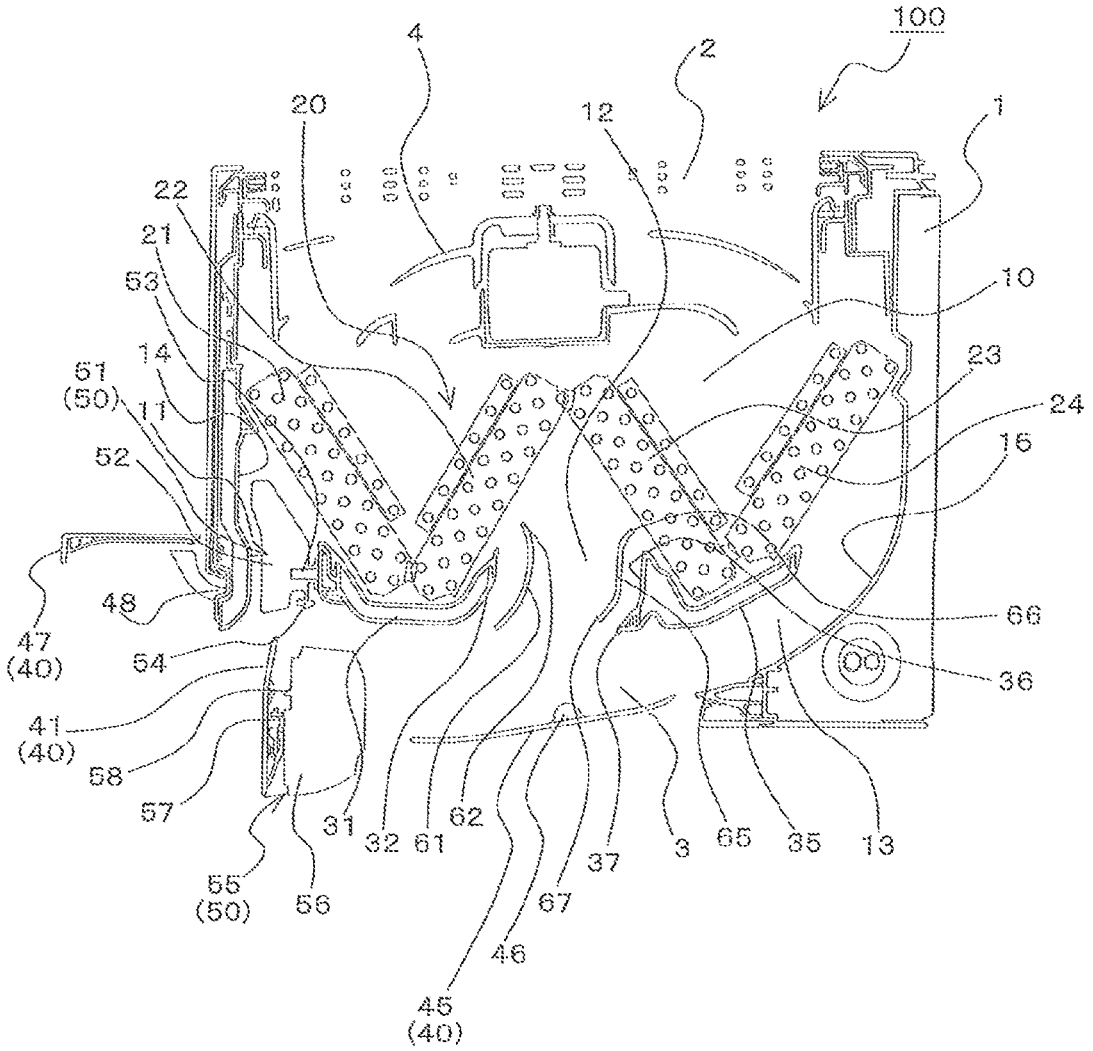
FIG. 11 is an illustration for explaining the cooling operation of the indoor unit for an air-conditioning apparatus according to Embodiment 1.
Figure 12:
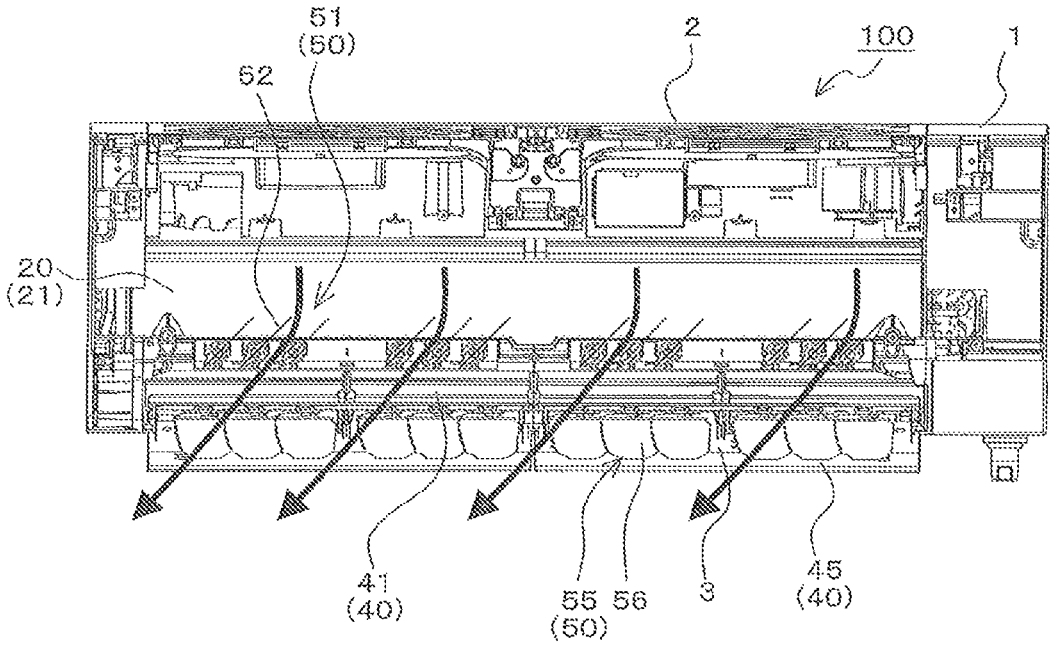
FIG. 12 is an illustration for explaining the cooling operation of the indoor unit for an air-conditioning apparatus according to Embodiment 1.
Figure 13:
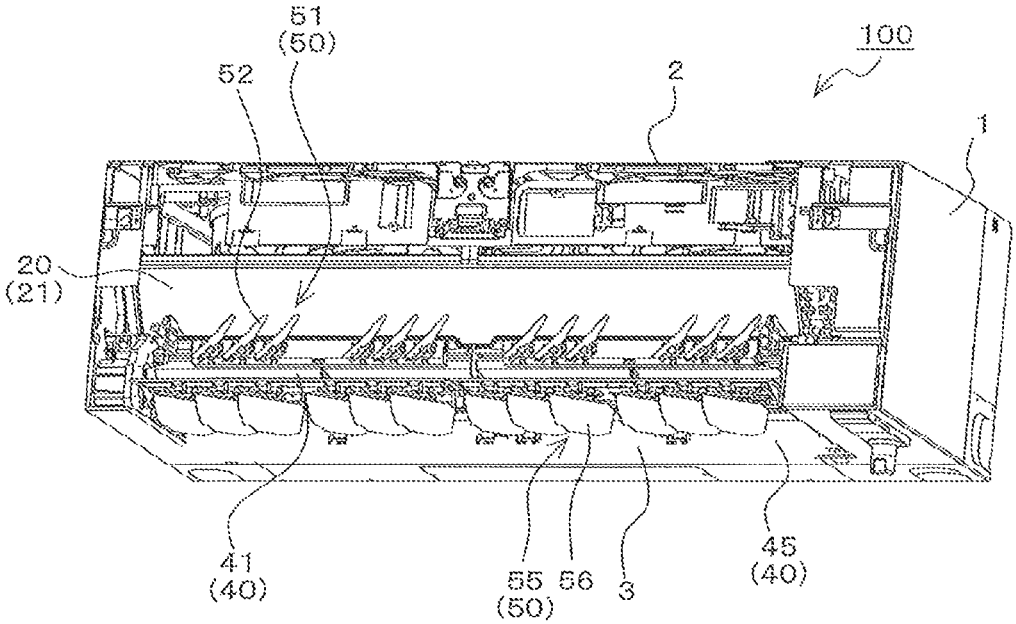
FIG. 13 is an illustration for explaining the cooling operation of the indoor unit for an air-conditioning apparatus according to Embodiment 1.

FIGS. 10 to 13 are illustrations for explaining the cooling operation of the indoor unit for an air-conditioning apparatus according to Embodiment 1. FIGS. 10 and 11 are longitudinal sectional views of the indoor unit 100 as seen from right. FIG. 12 is a front view of the indoor unit 100 with the front wall 14 of the airflow path 10 and the front up/down airflow direction flap 47 removed. FIG. 13 is a perspective view, as seen from the right front, of the indoor unit 100 with the front wall 14 of the airflow path 10 and the front up/down airflow direction flap 47 removed.

When an instruction to perform cooling operation is input to the control device 90 via the remote controller 81 or other devices, as illustrated in FIGS. 10 and 11, the control device 90 causes the rearward up/down airflow direction flap 45 to rotate such that the front end portion of the rearward up/down airflow direction flap 45 moves down. This causes the rearward up/down airflow direction flap 45 to change its angle from an angle in its closed state when the indoor unit 100 is not in operation to an angle in its open state when the indoor unit 100 is in operation. In Embodiment 1, the rearward up/down airflow direction flap 45 is controlled between two positions, including its position when the indoor unit 100 is not in operation and its position when the indoor unit 100 is in operation. This is due to the following reason. Since the rearward up/down airflow direction flap 45 is used to guide air blown out from the second airflow path 12 and the third airflow path 13 to the forward up/down airflow direction flap 41, there is no need to stop the rearward up/down airflow direction flap 45 in a given position between the two positions mentioned above, in other words, there is no need to continuously control the angle of the rearward up/down airflow direction flap 45. Controlling the rearward up/down airflow direction flap 45 in this way facilitates control of the rearward up/down airflow direction flap 45.

Further, the control device 90 causes the front up/down airflow direction flap 47 to rotate until the lower end portion of the front up/down airflow direction flap 47 is located above the air outlet 3, thus fully opening the portion of the air outlet 3 located on the front face portion of the casing 1. Then, the control device 90 starts the axial fan 4, and controls the rotation speed of the axial fan 4 so that an air quantity specified by using the remote controller 81 or other devices is attained. Further, the control device 90 causes the forward up/down airflow direction flap 41 to turn over, and controls the angle of the forward up/down airflow direction flap 41.

Upon starting the axial fan 4, indoor air is sucked into the airflow path 10 of the casing 1 from the air inlet 2. This air is sent to the indoor heat exchanger 20 by the axial fan 4. When this air passes through the indoor heat exchanger 20, the air is cooled by the refrigerant flowing within the indoor heat exchanger 20. At this time, the air that has passed through the first heat exchanger 21 is blown out to the first airflow path 11. The air that has passed through the second heat exchanger 22 and the third heat exchanger 23 is blown out to the second airflow path 12. The air that has passed through the fourth heat exchanger 24 is blown out to the third airflow path 13.

Most of the air blown out to the first airflow path 11 is air that has flown along the front wall 14. For this reason, there is relatively little airflow turbulence in the first airflow path 11. Likewise, most of the air blown out to the third airflow path 13 is air that has flown along the back wall 15. For this reason, there is relatively little airflow turbulence in the third airflow path 13 as well. By contrast, the air blown out to the second airflow path 12 is produced by a mixture of air that has passed through the second heat exchanger 22 and air that has passed through the third heat exchanger 23, that is, a collision of the two airflows. This results in greater airflow turbulence in the second airflow path 12, which may lead to increased pressure loss in the second airflow path 12. In this regard, in Embodiment 1, the forward straightening vane 61 and the rearward straightening vane 65 are disposed in the second airflow path 12. This ensures that when a mixture of the air having passed through the second heat exchanger 22 and the air having passed through the third heat exchanger 23 enters the second airflow path 12, the mixed airflow is straightened by the forward straightening vane 61 and the rearward straightening vane 65. This allows for reduced pressure loss in the second airflow path 12.

A portion of the air having passed through the second heat exchanger 22 is routed along the top face portion of the forward drain pan 31, and flows upward into the space between the second heat exchanger 22 and the third heat exchanger 23. This airflow can also cause pressure loss in the second airflow path 12 to increase. In this regard, in Embodiment 1, this airflow is guided by the top end portion 62 of the forward straightening vane 61 to the space between the forward drain pan 31 and the forward straightening vane 61, and straightened in that space. That is, reduced pressure loss in the second airflow path 12 can be accomplished by the forward straightening vane 61 alone.

Likewise, a portion of the air having passed through the third heat exchanger 23 is routed along the top face portion of the rearward drain pan 35, and flows upward into the space between the second heat exchanger 22 and the third heat exchanger 23. This airflow can also cause pressure loss in the second airflow path 12 to increase. In this regard, in Embodiment 1, this airflow is guided by the top end portion 66 of the rearward straightening vane 65 to the space between the rearward drain pan 35 and the rearward straightening vane 65, and straightened in that space. That is, pressure loss in the second airflow path 12 can be reduced by use of the rearward straightening vane 65 alone. Further, the direction of the airflow between the rearward drain pan 35 and the rearward straightening vane 65 is bent forward by the projection 37 of the rearward drain pan 35 and the bottom end portion 67 of the rearward straightening vane 65. This also makes it possible to reduce the pressure loss that occurs when air blown out from the second airflow path 12 is bent forward by the rearward up/down airflow direction flap 45.

Air blown out from the first airflow path 11 flows toward the forward up/down airflow direction flap 41. Air blown out from the second airflow path 12 and the third airflow path 13 is also guided toward the forward up/down airflow direction flap 41 after being bent forward by the rearward up/down airflow direction flap 45. This ensures that as the angle of the forward up/down airflow direction flap 41 is controlled by the control device 90, the angle of air blown out from the air outlet 3 can be adjusted.

For example, the control device 90 controls the angle of the forward up/down airflow direction flap 41 as illustrated in FIG. 10. More specifically, in cooling operation, air blown out from the air outlet 3 is cooler, and hence heavier, than indoor air. Thus, the air blown out from the air outlet 3 tends to flow downward. Accordingly, to send the air blown out from the air outlet 3 over greater distances in the indoor space, the control device 90 sets the forward up/down airflow direction flap 41 to the horizontal position in side view. This allows cold air blown out from the air outlet 3 to be sent over greater distances in the indoor space.

At this time, in Embodiment 1, at least when the forward up/down airflow direction flap 41 is set to the horizontal position in side view during operation of the indoor unit 100, the front end portion of the forward up/down airflow direction flap 41 is located forward of the first airflow path 11. This ensures that air blown out from the first airflow path 11 hits the forward up/down airflow direction flap 41, thus enhancing the accuracy with which the up/down angle of air blown out from the air outlet 3 is controlled. Further, in Embodiment 1, the front up/down airflow direction flap 47 is rotated until the lower end portion of the front up/down airflow direction flap 47 is located above the air outlet 3 so that the portion of the air outlet 3 located on the front face portion of the casing 1 becomes fully open. This configuration prevents air blown out from the air outlet 3 from hitting the front up/down airflow direction flap 47 to cause pressure loss to increase. This configuration also makes it possible to prevent cold air blown out from the air outlet 3 from hitting the front up/down airflow direction flap 47, thus preventing condensation from forming on the front up/down airflow direction flap 47.

Further, for example, the control device 90 is also able to control the angle of the forward up/down airflow direction flap 41 as illustrated in FIG. 11. More specifically, for cases such as when it is instructed by the remote controller 81 to blow air downward, or when the user's presence near the indoor unit 100 is detected by the infrared sensor 80, the control device 90 sets the forward up/down airflow direction flap 41 to the vertical position in side view. This allows cold air blown out from the air outlet 3 to be sent to locations near the indoor unit 100.

Further, for example, the control device 90 is also able to stop the forward up/down airflow direction flap 41 at a given angle between the state illustrated in FIG. 10 and the state illustrated in FIG. 11. Further, for example, the control device 90 is also able to continuously change the angle of the forward up/down airflow direction flap 41 between the state illustrated in FIG. 10 and the state illustrated in FIG. 11, thus enabling swing control of the blowing direction of cold air from the air outlet 3.

When adjusting the left/right angle of air blown out from the air outlet 3 based on an instruction from the remote controller 81, the detection result of the infrared sensor 80, or other information, the control device 90 controls the first left/right airflow direction flap 51 and the second left/right airflow direction flap 55.

For example, when it is desired to blow out air to the left from the air outlet 3 in the case of the arrangement illustrated in FIGS. 12 and 13, the control device 90 controls the first left/right airflow direction flap 51 in a manner that causes the plate members 52 to tilt, more specifically, in a manner that causes the lower end portion of the plate members 52 to be located on the left side relative to the upper end portion of the plate members 52. As a result, the left/right angle of air blown out from the first airflow path 11 is adjusted. Likewise, the control device 90 controls the second left/right airflow direction flap 55 in a manner that causes the plate members 56 to tilt, more specifically, in a manner that causes the forward end portion of the plate members 56 to be located on the left side relative to the rearward end portion of the plate members 56. As a result, the left/right angle of air blown out from the second airflow path 12 and the third airflow path 13 and guided forward by the rearward up/down airflow direction flap 45 is adjusted.

The first left/right airflow direction flap 51 and the second left/right airflow direction flap 55 are controlled in this way to allow air to be blown out to the left from the air outlet 3.

The angle of tilt of the plate members 52 and the plate members 56 varies with the degree to which air blown out from the air outlet 3 is bent to the left. When it is desired to blow out air to the right from the air outlet 3, the control device 90 controls the first left/right airflow direction flap 51 and the second left/right airflow direction flap 55 in a manner that causes the plate members 52 and the plate members 56 to tilt in a direction opposite to the direction illustrated in FIGS. 12 and 13.

(Heating Operation)

Heating operation differs from cooling operation in the following two respects.

(1) Indoor air sucked into the airflow path 10 is heated by refrigerant flowing within the indoor heat exchanger 20 as the indoor air passes through the indoor heat exchanger 20.

(2) The angle of the front up/down airflow direction flap 47 is controlled in accordance with the angle of the forward up/down airflow direction flap 41.

Accordingly, the following describes a method for controlling the forward up/down airflow direction flap 41 and the front up/down airflow direction flap 47 in heating operation.

Figure 14:
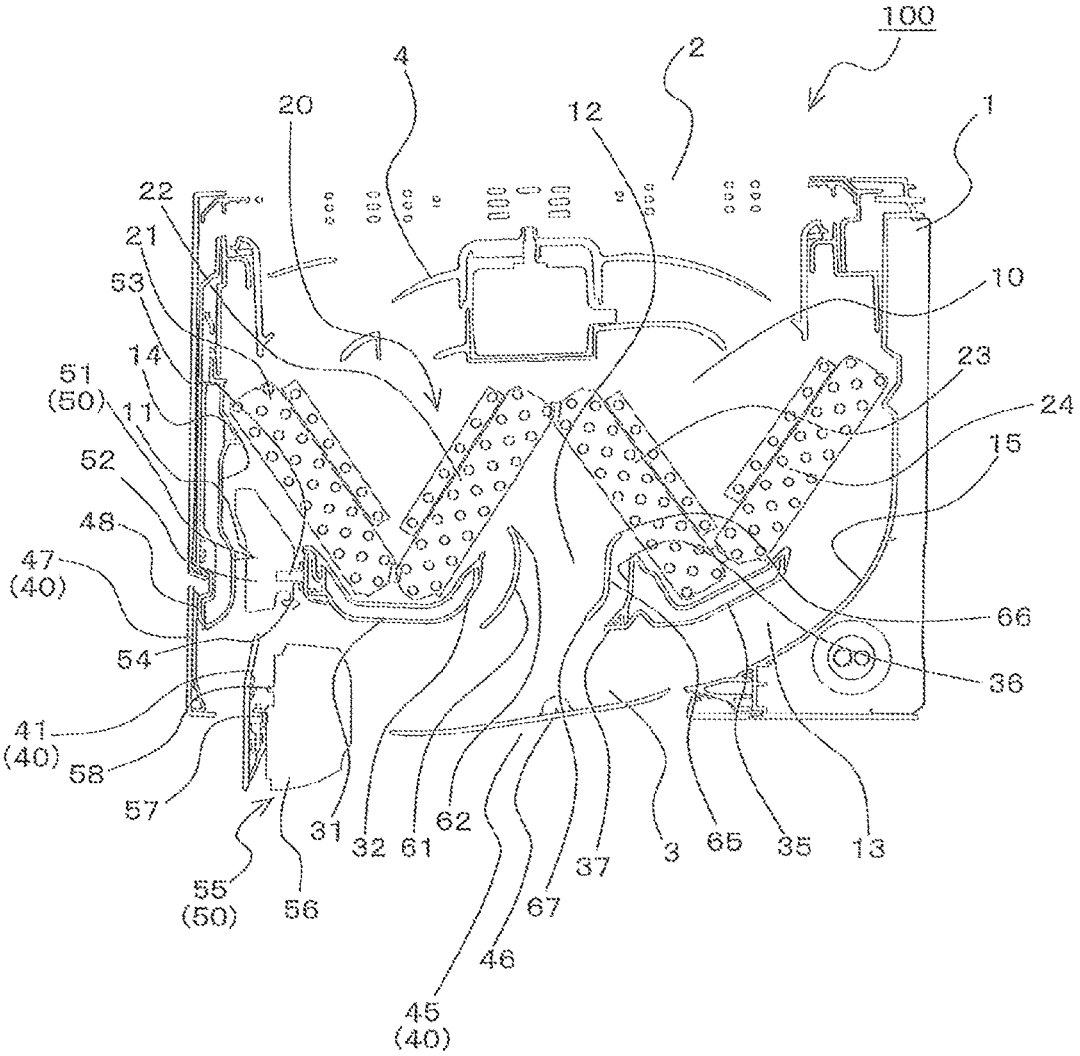
FIG. 14 is an illustration for explaining the heating operation of the indoor unit for an air-conditioning apparatus according to Embodiment 1.
Figure 15:
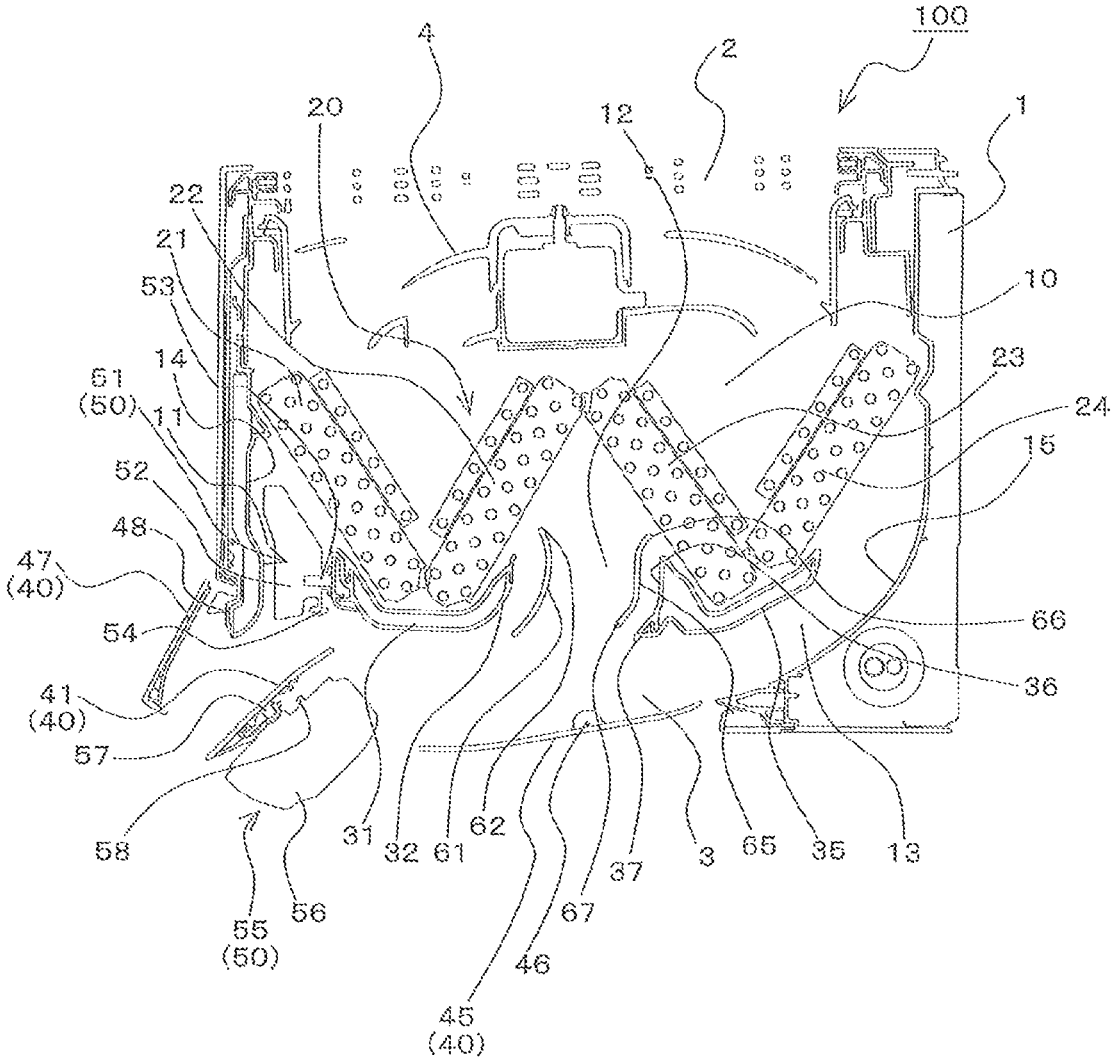
FIG. 15 is an illustration for explaining the heating operation of the indoor unit for an air-conditioning apparatus according to Embodiment 1.

FIGS. 14 and 15 illustrate heating operation of the indoor unit for an air-conditioning apparatus according to Embodiment 1. FIGS. 14 and 15 are longitudinal sectional views of the indoor unit 100 as seen from right.

When an instruction to perform heating operation is input to the control device 90 via the remote controller 81 or other devices, as illustrated in FIGS. 14 and 15, the control device 90 causes the rearward up/down airflow direction flap 45 to rotate such that the front end portion of the rearward up/down airflow direction flap 45 moves down. This causes the rearward up/down airflow direction flap 45 to change its angle from an angle in its closed state when the indoor unit 100 is not in operation to an angle in its open state when the indoor unit 100 is in operation. Then, the control device 90 starts the axial fan 4, and controls the rotation speed of the axial fan 4 so that an air quantity specified by using the remote controller 81 or other devices is attained. The control device 90 causes the forward up/down airflow direction flap 41 to turn over, and controls the angle of the forward up/down airflow direction flap 41. Further, in heating operation, the control device 90 adjusts the angle of the front up/down airflow direction flap 47 in accordance with the angle of the forward up/down airflow direction flap 41.

For example, the control device 90 controls the respective angles of the forward up/down airflow direction flap 41 and the front up/down airflow direction flap 47 as illustrated in FIG. 14. More specifically, in hearing operation, the air blown out from the air outlet 3 is warmer, and hence lighter, than indoor air. Thus, the air blown out from the air outlet 3 tends to flow upward. Accordingly, to efficiently heat the indoor space with warm air blown out from the air outlet 3, the control device 90 sets the forward up/down airflow direction flap 41 to the vertical position in side view. This causes the warm air blown out from the air outlet 3 to be once directed toward the floor to enable efficient heating.

At this time, if the portion of the air outlet 3 located on the front face portion of the casing 1 is fully open as in cooling operation, warm air that has undergone heat exchange in the indoor heat exchanger 20 leaks from this portion, leading to reduced heating performance. Accordingly, the control device 90 controls the angle of the front up/down airflow direction flap 47 such that the front up/down airflow direction flap 47 extends along the forward up/down airflow direction flap 41 in side view, in other words, such that the forward up/down airflow direction flap 41 and the front up/down airflow direction flap 47 are substantially parallel to each other in side view. More specifically, as illustrated in FIG. 14, if the forward up/down airflow direction flap 41 is set to the vertical position in side view, the control device 90 also sets the front up/down airflow direction flap 47 to the vertical position in side view so that the portion of the air outlet 3 located on the front face portion of the casing 1 becomes fully open. As a result, warm air likely to leak from the portion of the air outlet 3 located on the front face portion of the casing 1 is guided downward by the front up/down airflow direction flap 47, and blown out in substantially the same direction as the air whose up/down angle has been adjusted by the forward up/down airflow direction flap 41.

There are cases where, for example, based on an instruction from the remote controller 81, the detection result of the infrared sensor 80, or other information, the control device 90 causes warm air to blow out from the air outlet 3 obliquely downward as illustrated in FIG. 15. In such cases, the control device 90 controls the forward up/down airflow direction flap 41 such that the forward up/down airflow direction flap 41 tilts obliquely downward from its rear end portion to its front end portion. At this time, the control device 90 also controls the angle of the front up/down airflow direction flap 47 such that the front up/down airflow direction flap 47 extends along the forward up/down airflow direction flap 41 in side view, in other words, such that the forward up/down airflow direction flap 41 and the front up/down airflow direction flap 47 are substantially parallel to each other in side view. As a result, warm air likely to leak from the portion of the air outlet 3 located on the front face portion of the casing 1 is guided downward by the front up/down airflow direction flap 47, and blown out in substantially the same direction as the air whose up/down angle has been adjusted by the forward up/down airflow direction flap 41.

In heating operation, the forward up/down airflow direction flap 41 is rotatable between the horizontal position and the vertical position as in cooling operation. This makes it possible to position the forward up/down airflow direction flap 41 horizontally for horizontal blowing, and also enables swing control of the blowing angle of cold air from the air outlet 3. At this time, the control device 90 may control the angle of the front up/down airflow direction flap 47 such that the front up/down airflow direction flap 47 extends along the forward up/down airflow direction flap 41 in side view, in other words, such that the forward up/down airflow direction flap 41 and the front up/down airflow direction flap 47 are substantially parallel to each other in side view.

As described above, the indoor unit 100 for an air-conditioning apparatus according to Embodiment 1 employs, as the up/down airflow direction flap 40, the forward up/down airflow direction flap 41 and the rearward up/down airflow direction flap 45 configured as mentioned above. Further, the indoor unit 100 according to Embodiment 1 uses the forward up/down airflow direction flap 41 and the rearward up/down airflow direction flap 45 to adjust the up/down angle of air blown out from the air outlet 3. That is, the indoor unit 100 according to Embodiment 1 allows the up/down angle of air blown out from the air outlet 3 to be adjusted by using a number of up/down airflow direction flaps 40 smaller than the number of parts into which the airflow path 10 is divided. As a result, the indoor unit 100 according to Embodiment 1 allows for simplified structure and control of the up/down airflow direction flap 40.

The indoor unit 100 for an air-conditioning apparatus according to Embodiment 1 employs, as the left/right airflow direction flap 50, the first left/right airflow direction flap 51 and the second left/right airflow direction flap 55 configured as mentioned above. Further, the indoor unit 100 according to Embodiment 1 uses the first left/right airflow direction flap 51 and the second left/right airflow direction flap 55 to adjust the left/right angle of air blown out from the air outlet 3. That is, the indoor unit 100 according to Embodiment 1 allows the left/right angle of air blown out from the air outlet 3 to be adjusted by using a number of left/right airflow direction flaps 50 smaller than the number of parts into which the airflow path 10 is divided. As a result, the indoor unit 100 according to Embodiment 1 allows for simplified structure and control of the left/right airflow direction flap 50.

In Embodiment 1, the rearward up/down airflow direction flap 45 is controlled between two positions, that is, its position when the indoor unit 100 is not in operation and its position when the indoor unit 100 is in operation. This is not to be construed restrictively. The angle of the rearward up/down airflow direction flap 45 may be controlled in accordance with the angle of the forward up/down airflow direction flap 41. As described above, in Embodiment 1, the second left/right airflow direction flap 55 is disposed on the forward up/down airflow direction flap 41. Consequently, the height at which the second left/right airflow direction flap 55 is positioned varies with the angle of the forward up/down airflow direction flap 41. In this regard, controlling the angle of the rearward up/down airflow direction flap 45 in accordance with the angle of the forward up/down airflow direction flap 41 allows air blown out from the second airflow path 12 and the third airflow path 13 to be guided to the second left/right airflow direction flap 55 with greater accuracy, thus improving the accuracy of airflow direction control.

Embodiment 2

In Embodiment 1, the forward up/down air direction flap 41 is provided with the second left/right airflow direction flap 55, and the forward up/down airflow direction flap 41 is rotated to set the second left/right airflow direction flap 55 to a usage position in which the second left/right airflow direction flap 55 is used. This is not to be construed restrictively. For example, the following structure may be employed to set the second left/right airflow direction flap 55 to its usage position. The following description of Embodiment 2 assumes that features not specifically described with reference to Embodiment 2 are similar to those in Embodiment 1, and functions and components identical to those in Embodiment 1 are denoted by the same reference signs.

Figure 16:
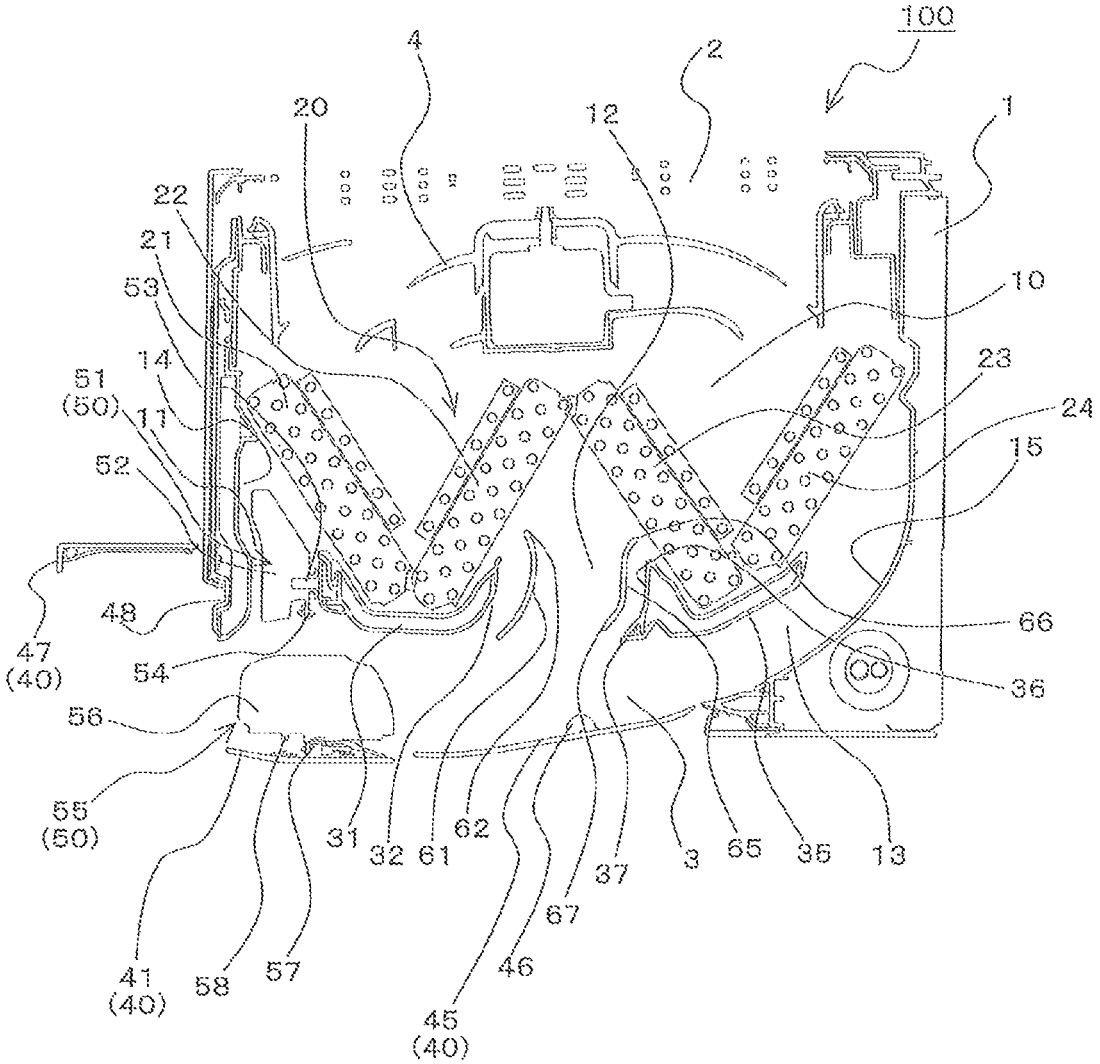
FIG. 16 is a longitudinal sectional view, as seen from right, of an indoor unit for an air-conditioning apparatus according to Embodiment 2 of the present invention.

FIG. 16 is a longitudinal sectional view, as seen from right, of an indoor unit for an air-conditioning apparatus according to Embodiment 2 of the present invention. FIG. 16 illustrates the indoor unit 100 with the second left/right airflow direction flap 55 set to the usage position, more specifically, the indoor unit 100 during cooling operation. The state in which the indoor unit 100 according to Embodiment 2 is not in operation is the same as that illustrated in FIG. 6 with reference to Embodiment 1.

The indoor unit 100 according to Embodiment 2 includes a slide mechanism for causing the forward up/down airflow direction flap 41 to slide downward. The structure of the indoor unit 100 is such that when the indoor unit 100 is to perform cooling operation or heating operation, the forward up/down airflow direction flap 41 slides downward to set the second left/right airflow direction flap 55 to its usage position. Accordingly, the second left/right airflow direction flap 55 is disposed on a side of the forward up/down airflow direction flap 41 that becomes the top side when the forward up/down airflow direction flap 41 is set to the horizontal position during operation of the indoor unit 100. The slide mechanism is mounted on the casing 1. This slide mechanism is controlled by the control device 90.

With the indoor unit 100 for an air-conditioning apparatus configured as described above, when the indoor unit 100 is in operation, the second left/right airflow direction flap 55 is disposed on the top side of the forward up/down airflow direction flap 41. As a result, during operation of the indoor unit 100, the second left/right airflow direction flap 55 is not easily visible from the user, thus further enhancing the design of the indoor unit 100.

Further, when the indoor unit 100 is in operation, the second left/right airflow direction flap 55 is opposed to the first airflow path 11. That is, air blown out from the first airflow path 11 can be bent in the left/right direction by the second left/right airflow direction flap 55. If the above-mentioned structure according to Embodiment 2 is used to set the second left/right airflow direction flap 55 to its usage position, it is also possible to obviate the first left/right airflow direction flap 51.

If the second left/right airflow direction flap 55 is to be set to its usage position as in Embodiment 2, the slide mechanism is supported on the casing 1 by means of a cantilever structure. This necessitates a robust slide mechanism. Further, if the second left/right airflow direction flap 55 is to be set to its usage position as in Embodiment 2, a driving device for moving the second left/right airflow direction flap 55 to its usage position is required in addition to the driving device used to control the angle of the forward up/down airflow direction flap 41. By contrast, if the structure according to Embodiment 1 is employed, that is, if the forward up/down airflow direction flap 41 is rotated to set the second left/right airflow direction flap 55 to its usage position, no slide mechanism is required. Further, with the structure according to Embodiment 1, the driving device used to control the angle of the forward up/down airflow direction flap 41 can be used as a driving device for moving the second left/right airflow direction flap 55 to its usage position. Therefore, if the structure according to Embodiment 1 is employed, that is, if the forward up/down airflow direction flap 41 is rotated to set the second left/right airflow direction flap 55 to its usage position, this enables inexpensive manufacture of the indoor unit 100.

Embodiment 3

If the axial fans 4 are to be arranged side by side in the left/right direction of the casing 1, the indoor unit 100 may be configured as described below. The following description of Embodiment 3 assumes that features not specifically described with reference to Embodiment 3 are similar to those in Embodiment 1 or 2, and functions and components identical to those in Embodiment 1 or 2 are denoted by the same reference signs. In Embodiment 3, for the convenience of explanation, the axial fan 4 located on the right side will be sometimes referred to as axial fan 4*a*, and the axial fan 4 located on the left side will be sometimes referred to as axial fan 4*b*.

Figure 17:
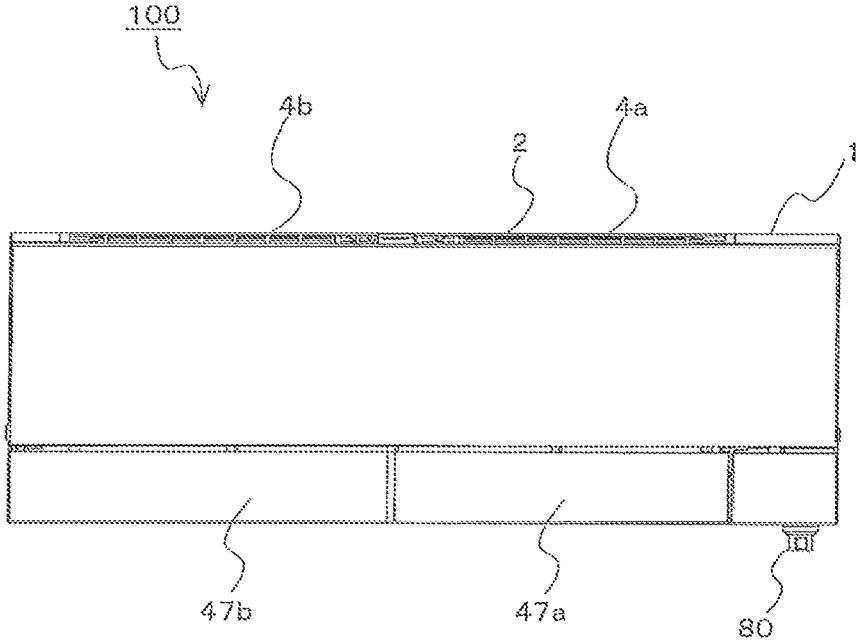
FIG. 17 is a front view of an indoor unit for an air-conditioning apparatus according to Embodiment 3 of the present invention.
Figure 18:
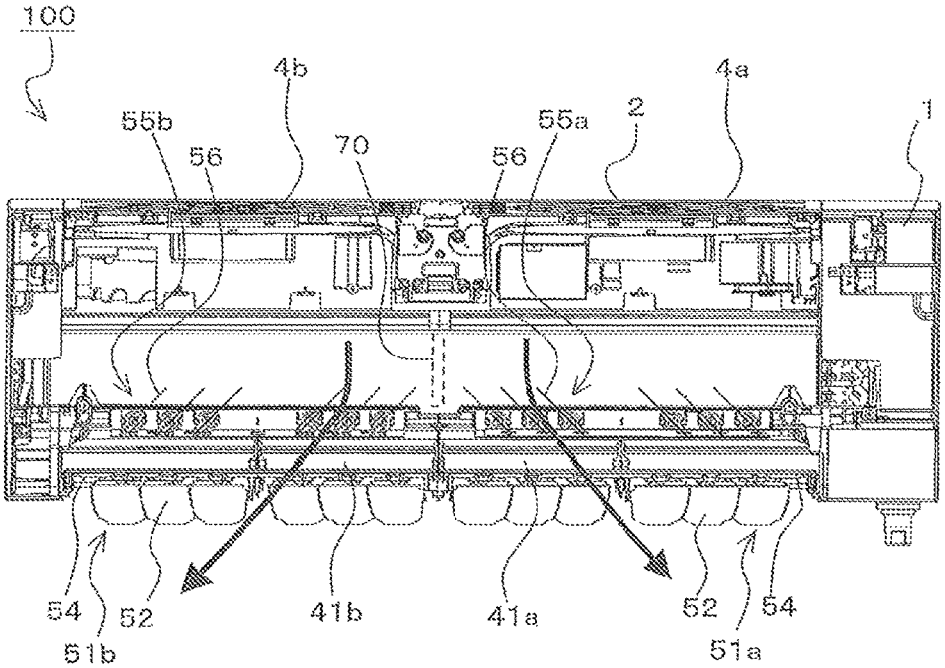
FIG. 18 is a front view of the indoor unit for an air-conditioning apparatus according to Embodiment 3 of the present invention.
Figure 19:
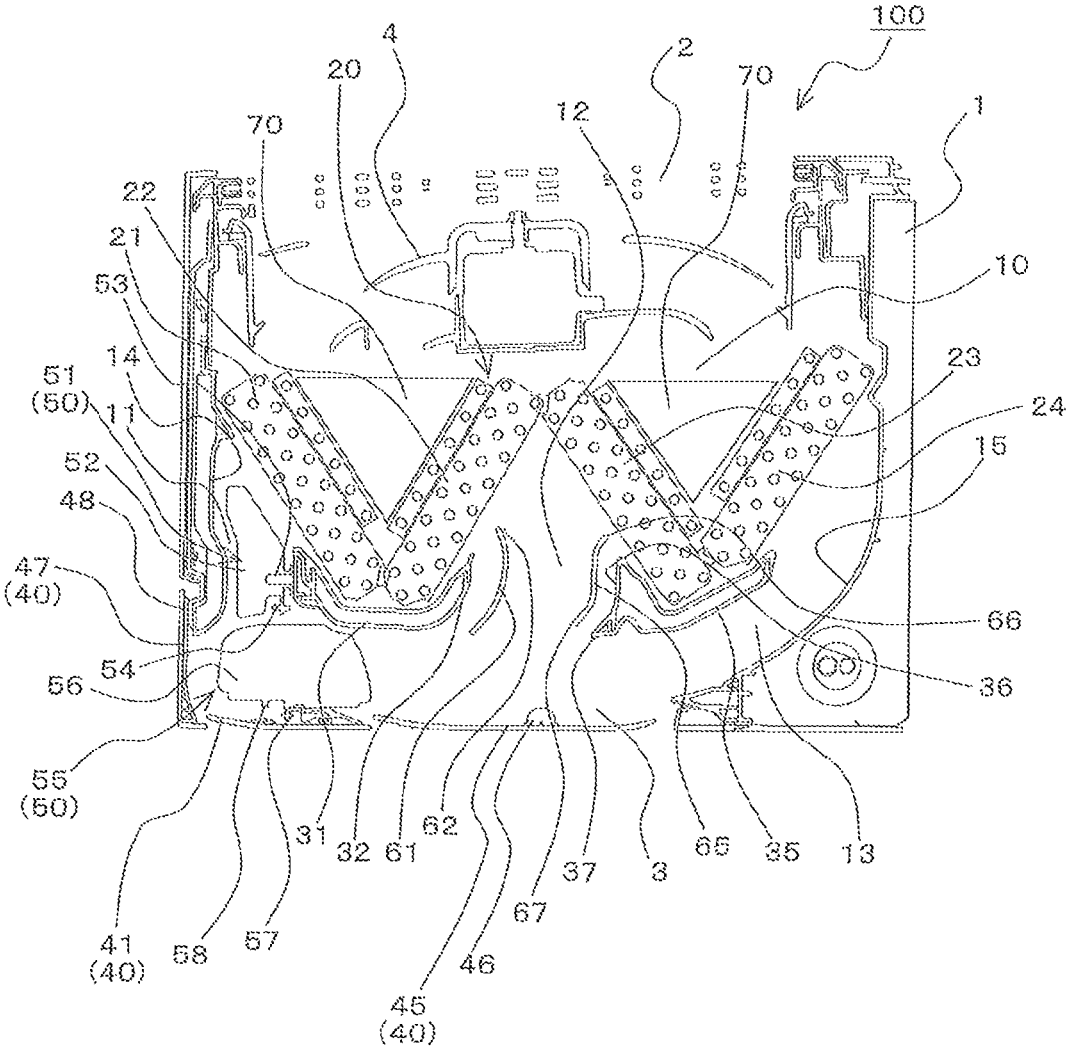
FIG. 19 is a longitudinal sectional view, as seen from right, of the indoor unit for an air-conditioning apparatus according to Embodiment 3 of the present invention.
Figure 20:
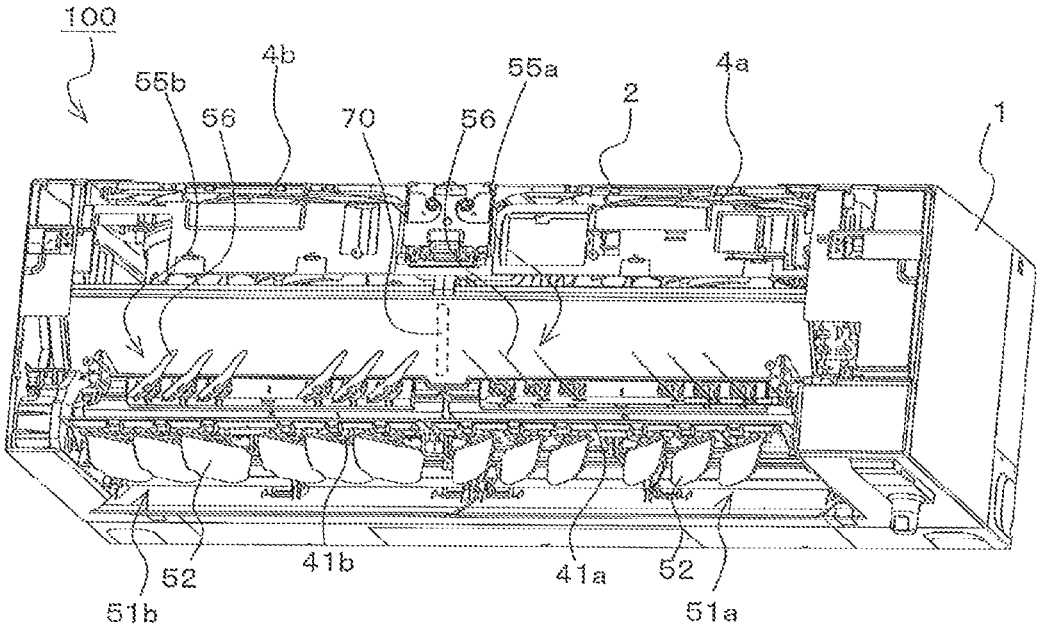
FIG. 20 is a perspective view, as seen from the right front, of the indoor unit for an air-conditioning apparatus according to Embodiment 3 of the present invention.

FIGS. 17 and 18 are front views of an indoor unit for an air-conditioning apparatus according to Embodiment 3 of the present invention. FIG. 19 is a longitudinal sectional view, as seen from right, of the indoor unit for an air-conditioning apparatus according to Embodiment 3 of the present invention. FIG. 20 is a perspective view, as seen from the right front, of the indoor unit for an air-conditioning apparatus according to Embodiment 3 of the present invention.

FIGS. 18 and 20 illustrate a state in which the front wall 14 of the airflow path 10 and the front up/down airflow direction flap 47 are removed.

The indoor unit 100 according to Embodiment 3 includes a partition plate 70 that is disposed between adjacent axial fans 4 in plan view to divide the airflow path 10 for each individual axial fan 4. In Embodiment 3, the partition plate 70 is disposed between the first heat exchanger 21 and the second heat exchanger 22, and between the third heat exchanger 23 and the fourth heat exchanger 24. As a result, the airflow path 10 within the casing 1 is divided by the partition plate 70 into an airflow path located below the axial fan 4*a*, and an airflow path located below the axial fan 4*b*.

Further, in the indoor unit 100 according to Embodiment 3, among the up/down air direction flaps 40, up/down airflow direction flaps other than the rearward up/down airflow direction flap 45 are each divided into a number of parts equal to the number of axial fans 4.

More specifically, the forward up/down airflow direction flap 41 is divided into a forward up/down airflow direction flap 41*a* disposed below the axial fan 4*a*, and a forward up/down airflow direction flap 41*b* disposed below the axial fan 4*b*. The forward up/down airflow direction flap 41*a* and the forward up/down airflow direction flap 41*b* are connected to different driving devices, and can be controlled independently. That is, the control device 90 is able to individually control the angle of the forward up/down airflow direction flap 41*a* and the angle of the forward up/down airflow direction flap 41*b*.

Likewise, the front up/down airflow direction flap 47 is divided into a front up/down airflow direction flap 47*a* disposed below the axial fan 4*a*, and a front up/down airflow direction flap 47*b* disposed below the axial fan 4*b*. The front up/down airflow direction flap 47*a* and the front up/down airflow direction flap 47*b* are connected to different driving devices, and can be controlled independently. That is, the control device 90 is able to individually control the angle of the front up/down airflow direction flap 47*a* and the angle of the front up/down airflow direction flap 47*b*.

Further, in the indoor unit 100 according to Embodiment 3, the left/right airflow direction flap 50 is divided into a number of parts equal to the number of axial fans 4.

More specifically, the first left/right airflow direction flap 51 is divided into a first left/right airflow direction flap 51*a* disposed below the axial fan 4*a*, and a first left/right airflow direction flap 51*b* disposed below the axial fan 4*b*. The connecting member 54 that connects the plate members 52 of the first left/right airflow direction flap 51*a*, and the connecting member 54 that connects the plate members 52 of the first left/right airflow direction flap 51*b* are connected to different driving devices, and can be controlled independently. That is, the control device 90 is able to individually control the angle of the plate members 52 of the first left/right airflow direction flap 51*a* and the angle of the plate members 52 of the first left/right airflow direction flap 51*b*.

Likewise, the second left/right airflow direction flap 55 is divided into a second left/right airflow direction flap 55*a* disposed below the axial fan 4*a*, and a second left/right airflow direction flap 55*b* disposed below the axial fan 4*b*. The connecting member 58 that connects the plate members 56 of the second left/right airflow direction flap 55*a*, and the connecting member 58 that connects the plate members 56 of the second left/right airflow direction flap 55*b* are connected to different driving devices, and can be controlled independently. That is, the control device 90 is able to individually control the angle of the plate members 56 of the second left/right airflow direction flap 55*a* and the angle of the plate members 56 of the second left/right airflow direction flap 55*b*.

In the indoor unit 100 for an air-conditioning apparatus configured as described above, the airflow path 10 is divided for each individual axial fan 4. As a result, the quantity of air blowing out from the portion of the air outlet 3 located below the axial fan 4*a*, and the quantity of air blowing out from the portion of the air outlet 3 located below the axial fan 4*b* can be made to differ.

In the indoor unit 100 for an air-conditioning apparatus configured as described above, the forward up/down airflow direction flap 41 and the front up/down airflow direction flap 47 are divided for each individual axial fan 4. As a result, the up/down angle of air blown out from the portion of the air outlet 3 located below the axial fan 4*a*, and the up/down angle of air blown out from the portion of the air outlet 3 located below the axial fan 4*b* can be made to differ.

In the indoor unit 100 for an air-conditioning apparatus configured as described above, the first left/right airflow direction flap 51 and the second left/right airflow direction flap 55 are divided for each individual axial fan 4. As a result, the left/right angle of air blown out from the portion of the air outlet 3 located below the axial fan 4*a*, and the left/right angle of air blown out from the portion of the air outlet 3 located below the axial fan 4*b* can be made to differ. For example, as illustrated in FIGS. 18 and 20, air can be blown out to the right from the portion of the air outlet 3 located below the axial fan 4*a*, and air can be blown out to the left from the portion of the air outlet 3 located below the axial fan 4*b*.

Accordingly, the configuration of the indoor unit 100 according to Embodiment 3 allows different quantities of conditioned air to be supplied to a plurality of locations in the indoor space to enhance comfort in the indoor space.

If the angle of the rearward up/down airflow direction flap 45 is to be controlled in accordance with the angle of the forward up/down airflow direction flap 41, the rearward up/down airflow direction flap 45 may be divided into a rearward up/down airflow direction flap disposed below the axial fan 4*a*, and a rearward up/down airflow direction flap disposed below the axial fan 4*b*.

The invention claimed is:

1. An indoor unit for an air-conditioning apparatus, comprising:

a casing having
- an air inlet located on a top face portion,
- an air outlet extending from a bottom face portion to a lower front face portion, and
- an airflow path that communicates the air inlet and the air outlet with each other;

an axial fan disposed within the airflow path under the air inlet;

an indoor heat exchanger disposed within the airflow path under the axial fan, the indoor heat exchanger having a W-shape in side view;

a forward drain pan disposed within the airflow path below a forward valley portion of the indoor heat exchanger; and a rearward drain pan disposed within the airflow path below a rearward valley portion of the indoor heat exchanger, wherein the airflow path is divided by the forward drain pan and the rearward drain pan into a first airflow path, a second airflow path, and a third airflow path, the first airflow path being defined between a front wall of the airflow path and the forward drain pan, the second airflow path being defined between the forward drain pan and the rearward drain pan, the third airflow path being defined between the rearward drain pan and a back wall of the airflow path, wherein the indoor unit comprises an up/down airflow direction flap that adjusts an up/down angle of air blown out from the air outlet, the up/down airflow direction flap including a forward up/down airflow direction flap and a rearward up/down airflow direction flap that are disposed separately in a portion of the air outlet located on the bottom face portion of the casing and at least a front end portion of each of the forward up/down airflow direction flap and the rearward up/down airflow direction flap is swingable in an up/down direction, wherein the rearward up/down airflow direction flap is disposed under the second airflow path and the third airflow path such that in side view, the front end portion of the rearward up/down airflow direction flap is located at a same position as a front end portion of the second airflow path or located forward of the second airflow path, and wherein the forward up/down airflow direction flap is disposed such that in side view, the forward up/down airflow direction flap is located forward of the rearward up/down airflow direction flap and under the first airflow path.

2. The indoor unit of claim 1, wherein air blown out from the second airflow path and the third airflow path is guided to the forward up/down airflow direction flap by the rearward up/down airflow direction flap, and wherein an up/down angle of air blown out from the first airflow path, and an up/down angle of air guided from the rearward up/down airflow direction flap to the forward up/down airflow direction flap are adjusted by the forward up/down airflow direction flap to adjust the up/down angle of air blown out from the air outlet.

3. The indoor unit of claim 1, wherein the up/down airflow direction flap further includes a front up/down airflow direction flap disposed in a portion of the air outlet located on the front face portion of the casing such that in side view, at least a lower end portion of the front up/down airflow direction flap is swingable, the front up/down airflow direction flap adjusting an up/down angle of air blown out from the air outlet in a heating operation.

4. The indoor unit of claim 3, wherein in the heating operation, an angle of the front up/down airflow direction flap is controlled in accordance with an angle of the forward up/down airflow direction flap.

5. The indoor unit of claim 3, wherein in a cooling operation, an angle of the front up/down airflow direction flap is controlled such that the portion of the air outlet located on the front face portion of the casing becomes fully open.

6. The indoor unit of claim 1, further comprising a left/right airflow direction flap that adjusts a left/right angle of air blown out from the air outlet, the left/right airflow direction flap including a plurality of plate members each having an end portion that is swingable in a left/right direction.

7. The indoor unit of claim 6, wherein when the indoor unit is in operation, the forward up/down airflow direction flap rotates about a rotary shaft extending in the left/right direction so that the forward up/down airflow direction flap is turned over for use from a position of the forward up/down airflow direction flap when the indoor unit is not in operation, and wherein the left/right airflow direction flap includes a first left/right airflow direction flap disposed in the first airflow path, the first left/right airflow direction flap including a plurality of first plate members, at least one of an upper end portion and a lower end portion of each of the plurality of first plate members configured to be swingable in the left/right direction, and a second left/right airflow direction flap including a plurality of second plate members, at least one of a forward end portion and a rearward end portion of each of the plurality of second plate members configured to be swingable in the left/right direction, the second left/right airflow direction flap being disposed on a side of the forward up/down airflow direction flap that becomes a bottom side when the forward up/down airflow direction flap is set to a horizontal position during operation of the indoor unit.

8. The indoor unit of claim 7, wherein at least when the forward up/down airflow direction flap is set to a horizontal position in side view during operation of the indoor unit, a front end portion of the forward up/down airflow direction flap is located forward of the first airflow path.

9. The indoor unit of claim 7, wherein an angle of the rearward up/down airflow direction flap is controlled in accordance with an angle of the forward up/down airflow direction flap.

10. The indoor unit of claim 6, wherein when the indoor unit is in operation, the forward up/down airflow direction flap slides downward for use from a position of the forward up/down airflow direction flap when the indoor unit is not in operation, and wherein the left/right airflow direction flap is disposed on a side of the forward up/down airflow direction flap that becomes a top side when the forward up/down airflow direction flap is set to a horizontal position during operation of the indoor unit.

11. The indoor unit of claim 6, wherein the axial fan comprises a plurality of axial fans arranged side by side in the left/right direction, wherein the indoor unit comprises a partition plate disposed between two of the axial fans that are adjacent to each other in plan view, the partition plate dividing the airflow path for each of the axial fans, and wherein the left/right airflow direction flap is divided into a number of left/right airflow direction flaps equal to a number of the axial fans in a manner that allows each of the left/right airflow direction flaps to be controlled independently.

12. The indoor unit of claim 1, wherein the rearward up/down airflow direction flap is controlled between two positions, the two positions including a position of the rearward up/down airflow direction flap when the indoor unit is not in operation and a position of the rearward up/down airflow direction flap when the indoor unit is in operation.

13. The indoor unit of claim 1, wherein the axial fan comprises a plurality of axial fans arranged side by side in the left/right direction, wherein the indoor unit comprises a partition plate disposed between two of the axial fans that are adjacent to each other in plan view, the partition plate dividing the airflow path for each of the axial fans, and wherein the up/down airflow direction flap other than the rearward up/down airflow direction flap is divided into a number of up/down airflow direction flaps equal to a number of the axial fans in a manner that allows each of the up/down airflow direction flaps to be controlled independently.

14. The indoor unit of claim 13, wherein the rearward up/down airflow direction flap is divided into a number of rearward up/down airflow direction flaps equal to a number of the axial fans in a manner that allows each of the rearward up/down airflow direction flaps to be controlled independently.

15. The indoor unit of claim 1, wherein the indoor unit comprises a forward straightening vane disposed in rear of the forward drain pan.

16. The indoor unit of claim 15, wherein a top end portion of the forward straightening vane is located above the forward drain pan, and projects toward the forward drain pan in side view.

17. The indoor unit of claim 1, wherein the indoor unit comprises a rearward straightening vane disposed in front of the rearward drain pan.

18. The indoor unit of claim 17, wherein a top end portion of the rearward straightening vane is located above the rearward drain pan, and projects toward the rearward drain pan in side view.

19. The indoor unit of claim 17, wherein a lower end portion of the rearward drain pan has a projection that projects forward, and wherein a lower end portion of the rearward straightening vane projects forward along the projection.

* * * * *